United States Patent [19]

Colvin, Jr.

[11] Patent Number: 4,660,332

[45] **Date of Patent: * Apr. 28, 1987**

[54] PREFABRICATED FOLDING STRUCTURE

[75] Inventor: Harry Colvin, Jr., Barnegat, N.J.

[73] Assignee: Shanni International, Inc., Howell, N.J.

[ * ] Notice: The portion of the term of this patent subsequent to Oct. 8, 2002 has been disclaimed.

[21] Appl. No.: 699,095

[22] Filed: Feb. 7, 1985

Related U.S. Application Data

[63] Continuation-in-part of Ser. No. 491,815, May 5, 1983, Pat. No. 4,545,171.

[51] Int. Cl.[4] ..... E04B 1/344

[52] U.S. Cl. ..... 52/79.5; 52/71

[58] Field of Search ..... 52/79.5, 69, 64, 68; 52/71, 79.1, 143, 745

[56] References Cited

U.S. PATENT DOCUMENTS

| | | | |
|---|---|---|---|
| 2,744,781 | 5/1956 | Black | 52/68 X |
| 3,070,850 | 1/1963 | McClure | 52/69 |
| 3,103,709 | 9/1963 | Bolt | 52/79.5 |
| 3,107,116 | 10/1963 | Meaker | 52/68 X |
| 3,460,297 | 8/1969 | Fritz | 52/68 X |
| 3,501,875 | 3/1970 | DeMailly | 52/79.5 X |
| 4,545,171 | 10/1985 | Colvin | 52/79.5 |

*Primary Examiner*—J. Karl Bell

*Attorney, Agent, or Firm*—Pennie & Edmonds

[57] ABSTRACT

A prefabricated structure, illustratively a residential dwelling, having a prefabricated central core and a plurality of prefabricated floor, wall and roof members that pivotally fold inwardly about the central core to produce a compact folded structure which is easily transportable, and pivotally fold outwardly about the central core for quick and inexpensive on-site installation. Also, methods for erecting sturdy habitable structures and the sturdy habitable structures themselves.

45 Claims, 17 Drawing Figures

PREFABRICATED FOLDING STRUCTURE

CROSS REFERENCE TO OTHER APPLICATIONS

This application is a continuation-in-part of application Ser. No. 491,815, filed May 5, 1983, now U.S. Pat. No. 4,545,171.

BACKGROUND OF THE INVENTION

1. Field of the Invention

The invention relates to prefabricated structures, illustratively residential dwellings, which have a prefabricated central core and are comprised of a plurality of prefabricated floor, wall and roof members that fold inwardly about the core to produce a compact partially collapsed folded structure, which is easily transportable, and fold outwardly from the core for quick and inexpensive on-site installation.

2. Background of the Invention

Over the years, the vast majority of structures, particularly residential houses, were completely constructed on-site. Specifically, once a suitable building lot has been chosen by a prospective home owner or developer, the lot was sufficiently cleared to accommodate a suitable foundation for the home. Shortly thereafter, construction proceeded through a sequence of stages. For each stage to occur, necessary materials and skilled labor were brought to the site. For example, after the foundation was laid, the shell of the house was constructed by a team of carpenters which cut to length and appropriately nailed together a requisite number of standard dimension wooden studs, illustratively 8, 10 or 12 foot sections of 2"×4" or 2"×6" studs. Thereafter, exterior wall and roof sheathing, and interior sub-floors were installed using appropriately sized plywood sheets, followed by the installation of exterior siding and roof shingles. Simultaneously therewith, the windows and the heating, electrical and plumbing systems were installed by carpenters, heating contractors, electricians and plumbers, respectively. Insulation was then added to the structure followed by the installation of all the interior walls and floors. Thereafter, the necessary appliances were put in position and connected to the appropriate electrical and plumbing systems. This, in turn, was illustratively followed by all remaining interior work such as painting, wall-papering, installation of interior trim and the like and any external landscaping.

While complete on-site construction, in a manner typified by that described above, has been the predominant form of house construction, construction costs, noteably labor, have substantially increased during the past two decades to the point where a significant number of buyers can no longer afford the price of a new house.

Consequently, various alternatives have been put forth in the art aimed at providing economically priced housing. In general, these alternatives all involve prefabricating various portions of a house at a central facility or plant by resident teams of skilled labor, transporting these portions to a building site and then performing the remaining assembly work on-site. It was generally thought that by prefabricating all or a significant portion of a house, sufficient cost savings would occur so that the purchase price of the installed prefabricated house would be advantageously less than that of a similarly sized conventionally constructed house. However, for a variety of reasons, the installation cost of each of these prefabricated prior art structures was substantial and, when added to the cost of manufacture and delivery, caused the total cost of any of these prefabricated structures to exceed that of conventional construction.

One such prior art prefabricated structure is described in U.S. Pat. No. 3,501,875 (issued to J. J. de Mailly on Mar. 24, 1970). This house is comprised of a number of rooms whose walls have been prefabricated from stressed concrete. Each room is nested inside another, to form two groups of nested rooms which are then loaded onto a flat-bed truck for the shipment to a building site. During on-site installation, a crane lifts each room from its nested group and appropriately positions it on a floor which has been attached to a suitable foundation. The rooms are then attached to each other. Thereafter, a prefabricated roof is laid in place over all the positioned rooms.

A house of this type carries a significant installation cost for the following illustrative reasons. First, since wiring and plumbing cannot be run within concrete walls, this necessitates that the rooms be electrically wired and plumbed at the time of on-site installation. In addition, nesting prevents any closets from being installed in any room until after the house has been installed on-site. Furthermore, any foundation used to support this house must be sufficiently strong to support its substantial weight and is thus usually fabricated from reinforced concrete which is quite expensive. Lastly, since a prefabricated house of the type described in the '875 patent is not self-supporting, steel columns or pillars are incorporated into the walls in order to support the weight of the roof. Unfortunately, steel columns are not standard in residential construction and hence, further increase the cost of the house.

Another approach was disclosed in U.S. Pat. No. 3,348,344 (issued to L. Tatevossian on Oct. 24, 1967). There, the prefabricated house is comprised of a prewired and plumbed central core surrounded on each of two sides by a number of folding rooms which share a common end wall that rides along a track. Each room contains two side walls connected at one end to a respective end wall and at the other end to the central core. Each side wall has a full-height hinge which collapses the wall with accordion-like folds. For shipping, the walls and floors are all folded inwardly towards the central core, and the roof sections of the house are folded down around the folded walls. During installation, the house is first positioned on a suitable foundation. The roof sections are first raised and the floor is then extended. Thereafter, to unfold the house, each end wall is pulled outwardly on its track from the central core and is then secured in place at the end of its travel.

While the installation cost of this folding structure is less than that associated with the structure disclosed in the '875 patent, it is still too large, for the illustrative reasons indicated below, to make the house described in the '344 patent economically viable over a similarly sized conventionally constructed house. Specifically, because of the substantial weight supported by each end wall and the large amount of friction between each end wall and the track in which it rides—particularly if dirt enters the track, a substantial amount of effort is required to fully extend each end wall away from the central core. Hence, a bulldozer or other heavy equipment must be procured, usually by renting at a fairly significant cost, for use in extending these walls away from the core. Furthermore, the accordion-like folds, in the rooms surrounding the central core, prevent any closets from being located anywhere but in the central core. Consequently, this severely limits available closet space, and thus necessitates that any additional closets be constructed on-site. In addition, this house is primarily constructed from aluminum, which is a non-standard and expensive building material. While unrelated to cost, this prefabricated house possesses an additional drawback in that it has a relatively high center of gravity, which disadvantageously makes the house, when folded, readily susceptible to tipping over.

A further approach is discussed in Italian Pat. No. 574,311 (granted to G. Desegnat et al. on Mar. 15, 1978). This patent generally discloses the idea concept of longitudinally articulating various floor and wall partitions to form a prefabricated house. The patent states that the house is entirely shop built such that, after the partitions are unfolded the house is connected to utilities, an immediately inhabitable unit is provided. The disclosure of this patent however, does not provide or suggest any specific details which one skilled in the art could use to construct a practical operable unit.

SUMMARY OF THE INVENTION

The invention relates to a prefabricated folding structure comprising at least one pre-erected central core comprising at least two oppositely arranged wall members and a floor extending between the at least two wall members, at least a first pivoting floor section, first pivoting means connecting the first pivoting floor section to the central core floor, the first pivoting means comprising means for transferring the load of the first pivoting floor section to the central core floor, at least three pivotable wall members, first means for pivotally connecting the third of the pivotable wall members to the pivoting floor section, the first pivotal connection means comprising an elongated member foldable along a predetermined crease line and capable of substantially maintaining its configuration when placed in either a folded or an unfolded condition about the crease line by a predetermined force, second means for pivotally connecting the remaining pivotal wall members to one of the central core wall members, and a plurality of beams located above the central core for stabilizing and strengthening the central core. This prefabricated folding structure is capable of forming either a compact folded structure wherein the at least one pivoting floor section and the at least three pivotable wall members are pivotally positioned inwardly about the central core so as to rest in close proximity thereto and substantially parallel to the core wall member to which the two pivotal wall members are pivotally connected, or a sturdy habitable structure wherein the at least one first pivoting floor section and the at least three pivotable wall members are pivotally positioned outwardly from the central core so as to define at least one room adjacent to the central core.

The central core may comprises at least two pair of oppositely arranged wall members having a generally rectangular configuration, with a predetermined number of these wall members utilizable as exterior walls and the remaining central core wall members being interior walls.

The first pivoting means further comprises means for reducing frictional forces during rotation of the pivoting floor section. The first pivotal connecting means conform to a predetermined position of the third pivotable wall member relative to the pivoting floor section, which position can vary from a generally parallel initial position to a predetermined final position. In a preferred arrangement, the predetermined final position of the pivotable wall member is substantially perpendicular to the pivoting floor section.

Each of the second pivotal connection means is also capable of conforming to a predetermined position of the respective remaining pivotable wall members relative to the central core wall member. This position can vary from a generally parallel initial position to a predetermined final position. Here, a preferred predetermined final position of the pivotable wall member is substantially perpendicular to the central core wall member.

The prefabricated structure according to the invention can include at least one folding interior wall member for dividing the room, a plurality of ceiling beams above the room, and means for connecting the plurality of room ceiling beams to the plurality of central core ceiling beams for horizontal support. The plurality of room ceiling beams are also attached to and at least partially supported by the third pivotable wall member.

In one embodiment, the prefabricated structure described hereinabove further comprises a flat or conventional roof installed on the structure after it is unfolded.

The invention also relates to a prefabricated folding structure comprising at least one pre-erected central core comprising at least two pair of oppositely arranged wall members and a floor extending between the wall members, at least two pivoting floor sections, first pivoting means connecting a first pivoting floor section to the central core floor and second pivoting means connecting a second pivoting floor section to the opposite end of the central core floor, the first and second pivoting means each comprising means for transferring the load of the first and second pivoting floor sections to the central core floor and means for reducing frictional forces in the first and second pivoting means during rotation of the pivoting floor sections, at least two sets of three pivotable wall members, first means for pivotally connecting each of the third of the pivotable wall members to the first and second pivoting floor sections respectively, the first pivotal connection means comprising an elongated member foldable along a predetermined crease line and capable of substantially maintaining its configuration when placed either in a folded or an unfolded condition about the crease line by a predetermined force, the folded condition corresponding to a generally parallel initial position of the third pivotal wall members relative to its respective pivotal floor section and the unfolded condition corresponding to a predetermined final position of the third pivotal wall members relative to the respective pivoting floor section, second means for pivotally connecting each of the remaining pivotal wall members of each set to each respective side of the oppositely arranged central core wall members, the second pivotal connection means capable of conforming to a predetermined position of the respective remaining pivotal wall members relative to the central core wall members, which position can vary from a generally parallel initial condition to predetermined final position, and a plurality of beams located above the central core for stabilizing and strengthening the central core. This prefabricated folding structure is also capable of forming either a compact folded structure wherein the at least two pivoting floor sections and each of the at least three pivotable wall members are pivotally positioned inwardly about each respective side of the central core so as to rest in close proximity thereto and substantially parallel to each of the at least two core wall members, or a sturdy habitable structure wherein the first and second pivoting floor sections and the pivotable wall members are pivotally positioned outwardly from the central core so as to define at least two rooms adjacent to the central core.

The prefabricated structure according to this embodiment further comprises a plurality of ceiling beams above the rooms and means for connecting each of the plurality of room ceiling beams to each end of the plurality of central core ceiling beams for partial horizontal support. Also, the plurality of room ceiling beams are also attached to and at least partially supported by at least one of the pivotable wall members.

Preferably, one pre-erected central core is used, and it includes comprising two pair of oppositely arranged wall members having a generally rectangular configuration and a floor extending between the wall members wherein a predetermined number of the central core wall members are utilizable as exterior wall members and the remaining central core wall members are interior wall members. In this arrangement, the central core contains all necessary and desired plumbing and electrical control means, and preferably includes at least a substantially prefabricated kitchen and a substantially prefabricated bathroom.

In an alternate embodiment, the prefabricated folding structure of the invention can include a plurality of prefabricated roof support trusses attached to the upper sides of one pair of oppositely arranged central core wall members and a plurality of folding roof members pivotally connected to the prefabricated roof support trusses. The plurality of folding roof members are capable of folding downwardly onto the roof trusses or folding to a position parallel to the core wall members.

In addition, the prefabricated folding structure according to the folding roof structure may comprise upper and lower folding roof sections wherein each upper section is pivotally connected at one of its ends to a corresponding lower section and to the prefabricated roof support trusses. The lower folding roof sections are at least partially supported by a pivotable wall member which is attached to a pivoting floor section.

The prefabricated folding structure of the invention can further comprise a plurality of free standing partitions which in the compact folded structure are positioned substantially parallel to and alongside at least one of the interior the central core walls, or when the folding structure has been completely unfolded, are positioned to further define a predetermined number of rooms and closets arranged adjacent to the central core. The pivotable wall members and the pivoting floor sections are configured and dimensioned to provide sufficient free space parallel to the central core walls when the structure is folded for holding non-pivotally connected building components until the structure is unfolded.

The non-pivotally connected building materials comprise free standing wall partitions and roof brace supports. Also, the central core and pivotable wall members include all necessary cable and wiring requirements.

The invention also includes a method for erecting a sturdy habitable dwelling from a prefabricated folding structure which comprises prefabricating a compact folded structure as described hereinabove, transporting the compact folded structure to a construction site, supporting the compact folded structure on at least two properly positioned central core support means, unfolding the compact folded structure by pivoting the first pivoting floor section to a horizontal position onto support means, pivoting the third pivotable wall member to a vertical position with respect to the first pivoting floor section, pivoting the other pivotable wall members, and finishing final construction details to form the sturdy habitable structure. This method further comprises adding a plurality of ceiling beams above the room and attaching these ceiling beams to the central core ceiling beams.

When the prefabricated folding structure comprises at least two adjacent rooms, the compact folded structure is unfolded by pivoting the first pivoting floor section to a horizontal position ontosupport means, pivoting the second pivoting floor section to a horizontal position onto support means, pivoting each the third pivotable wall members to a final position relative to the first and second pivoting floor sections, and pivoting the remaining pivotable wall members according to a predetermined sequence to their final positions. Preferably, the final position of the third pivotable wall members is substantially perpendicular to the pivoting floor sections. The final structural details are then completed.

The predetermined sequence of unfolding the remaining pivotable wall members preferably comprises pivoting the outermost wall member outwardly to its final position, pivoting the next outermost wall member outwardly to its final position, and repeating these pivoting stepts until all remaining wall members are pivoted outwardly to their final position. The preferred final position of the remaining pivotable wall members is a substantially perpendicular position relative to the central core wall to which it is pivotably connected. Also, this method also contemplates adding a plurality of ceiling beams above the rooms and attaching these beams to each end of the central core ceiling beams.

In order to form a multi-story structure, the invention contemplates a method which comprises prefabricating a plurality of compact folded structures as described hereinabove, transporting the compact folded structures to a construction site; supporting a first compact folded structure on at least two properly positioned central core support means, unfolding the structure by pivoting each pivoting floor sections to a horizontal position onto a support means; pivoting each third pivotable wall member to a vertical position with respect to each pivoting folded floor section, unfolding the remaining pivotable wall members, positioning a second compact folded structure above the unfolded first structure; unfolding the second compact folded structure in the same manner as the first, and finishing the final structural details to form a sturdy habitable muti-story structure.

The method further comprises repeating the positioning and unfolding steps as often as necessary to form the desired number of stories then adding a plurality of ceiling beams above the rooms and attaching these beams to the central core ceiling beams. Alternately, a flat or conventional roof can then be installed on these ceiling beams, the uppermost structure can be provided with a plurality of prefabricated support trusses attached to its central core ceiling members and a plurality of folding roof members pivotably connected to the prefabricated roof trusses as described hereinabove.

The invention also relates to the sturdy habitable structures produced according to the above-described methods.

Accordingly, an object of this invention is to provide low-cost prefabricated structures which are not only economical to manufacture but are also easy and inexpensive to install on-site, to thereby provide significant cost savings over a similarly sized conventionally constructed structure.

A particular object is to install all the necessary systems—e.g. wiring, plumbing and heating, and appliances in the structure during prefabrication.

Another particular object is to minimize the need for any heavy machinery during installation of the structure and to minimize the labor and effort required for installation.

A further particular object is to eliminate the need for any non-standard building materials, and to minimize the weight of the structure thereby eliminating the need for both internal columns and a reinforced foundation.

Lastly, another object is to incorporate as much stability as possible into the structure in order to minimize the tendency of the structure to tip-over while it is being transported.

BRIEF DESCRIPTION OF THE DRAWING

The invention may be clearly understood from a consideration of the following detailed description and accompanying drawings, wherein.

Figure 10:
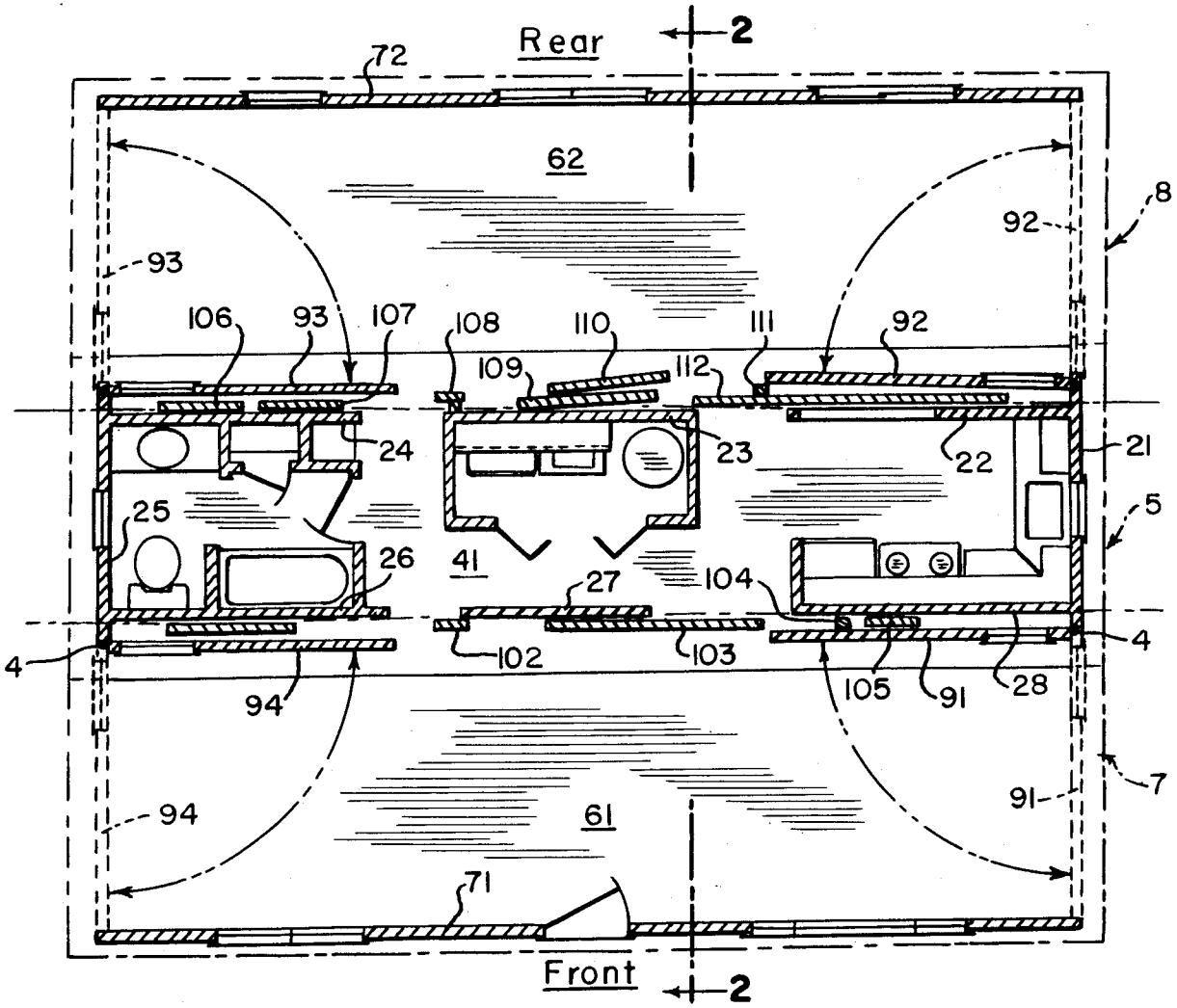
FIG. 10 is a plan elevational view of the interior of applicant's prefabricated folding structure, depicting the pivotal movement of folding exterior side walls 91, 92, 93 and 94.

In all the cross-sectional views indicated herein, which depict the folding structure in various stages of being unfolded, each cross-sectional view has been taken along a section generally similar to that shown by lines 2—2 of FIG. 10.

Also, to facilitate easy understanding, identical reference numerals are used to denote identical elements common to the figures.

DETAILED DESCRIPTION OF THE PREFERRED EMBODIMENTS

In the description that follows, the terms "beam", "stud", "plate", and "rafter" refer to support members as defined below:

(1) "beam" indicates a support member lying in a horizontal plane which has a height that is greater than its width;

(2) "stud" refers to a support member in a vertical position;

(3) "plate" refers to a flat support member (i.e.—one having a width that is greater than either the height or thickness); and (4) "rafter" is used to indicate a stud or beam in an angled position (i.e.—in a position other than horizontal or vertical).

Although the teachings of the present invention are applicable to a wide variety of structures of different weight, size, shape and materials for a variety of diverse uses, for purposes of the following description, the present invention will be described in the context of a single-story prefabricated residential dwelling (house).

Figure 1:
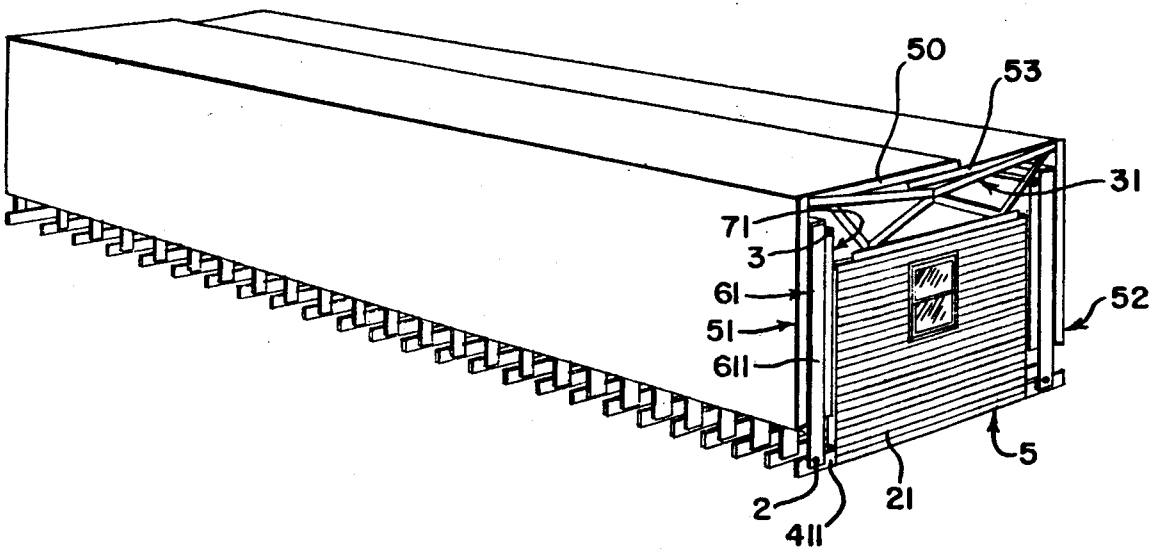
FIG. 1 is a perspective view of the outside of applicant's prefabricated folding structure shown in a completely folded shipping configuration.

FIG. 1 shows an exterior perspective view of a single-story prefabricated folding house constructed in accordance with applicant's invention and folded into a shipping configuration. As shown, the house contains a generally rectangularly shaped prefabricated central core 5—of which only exterior core wall 21 is shown. Positioned substantially parallel to and alongside this core wall—and discussed in greater detail in conjunction with FIG. 2—are the pivotable front and rear walls and pivoting floor sections.

On the left side of the core, a plurality of studs comprising pivotable exterior side wall 71 are pivotedly connected at one end of the core wall via pivots 3, to the outer end of pivoting floor section 61 at floor joist 611. Each of these joists in the pivoting floor sections are pivotedly connected at its other end, via pivot 2, to a respective one of the floor joists, e.g. joist 411, which joists together comprise the floor of central core.

The floor of the central core is comprised of a plurality of beams positioned substantially perpendicular to the walls of the central core, at least one beam oriented parallel to the walls of the central core connected to each of the plurality of beams, and acceptable decking material attached to and substantially covering the beams.

Preferably, these beams are made of lumber or steel, and the decking material can be plywood, fiberboard or variations of these. In a particularly advantageous embodiment, the decking comprises a subflooring of plywood or the like, followed by a final floor covering of hardwood planking, carpeting, tile or linoleum, depending upon the use for that particular section of the house.

The beams of the central core floor 41, illustratively, are 2"×10" wooden joists and those of each pivoting floor section are 2"×10" wooden joists. It is also possible to use 2"×8" joists for the pivoting floor sections, rather than 2"×10", to save material costs. All the joists comprising these floor members are arranged in an approximate 16" center-to-center spacing and are staggered such that an end of each floor joist in each pivoting floor member lies adjacent to an end of a corresponding floor joist in the central core. During prefabrication, both subflooring, of illustratively ⅝" thick plywood, and final floor covering, of illustratively ¼" hardwood planking, are nailed in place over all the joists comprising each of these floor members with exception of an area existing above pivots 2 between each pivoting floor section and the core floor. Subflooring and final flooring are installed over this area after the house has been fully unfolded, as discussed hereinbelow.

Affixed atop the central core is a ceiling member (not shown but see 40 in FIG. 2) upon which is positioned a plurality of prefabricated roof trusses—of which only truss 31 is shown. When a folding structure is used as a single story dwelling or the top floor of a multiple story dwelling, these trusses provide support for the folding roof which is comprised of lower folding roof sections 51 and 52 and upper folding roof sections 50 and 53. Each lower roof section is pivotedly connected at one of its ends to both an end of a respective upper folding roof section and to an end of each truss. In the shipping configuration as shown, the lower folding roof sections are pivotedly oriented downward to lie alongside the pivoting floor section, and the upper folding roof sections are pivotedly oriented downward to lie against each of the trusses.

These folding roof sections preferably comprise a plurality of rafters positioned substantially perpendicular to the walls of the core, at least one rafter positioned perpendicular to the plurality of rafters for connection thereto, a sheathing material connected to and substantially covering the rafters and moisture barrier means attached to the sheathing.

The moisture barrier is preferably builder felt, and a building exterior, such aluminum siding, shingles, cedar shakes, etc., is placed upon the moisture barrier and sheathing materials.

Since the weight of the folding structure is primarily supported by the walls comprising the central core, relatively little weight is borne by any of the pivoting wall, floor and ceiling members. Consequently, these pivoting members can be made fairly light in weight. Not only does this advantageously eliminate the need to use a reinforced foundation, but, in addition, this advantageously minimizes the effort required to pivotally move these members into proper position during installation of the structure. Thus, once the structure is properly positioned on its foundation, only a minimum amount of labor and no heavy machinery is needed to unfold the structure and complete the installation. These factors, coupled with the use of only inexpensive standard building materials and extensive prefabrication, advantageously permit substantial cost savings to be achieved over the cost of both prior art prefabricated structures and conventional construction.

The use of pivoting floor, wall, ceiling and roof members, which fold and unfold in a manner to be discussed in detail shortly, reduces the height and width of the folded home to specifically 11 feet 4 inches and 13 feet 8 inches, respectively. Advantageously, this greatly lowers the center of gravity of the folded home. Consequently, this ensures that the house is not susceptible to being tipped over during shipment. Hence, the house can be easily and safely transported on a flatbed truck to a suitable building site.

Once a suitable site has been appropriately excavated, a concrete foundation is laid. This foundation is provided with four points for supporting the folding structure. Two supports are located just below and outside of the core walls, and each of the two other supports is located under one of the pivoting floor sections. Thus, the two supports for the core hold the weight of the structure while the pivoting floor supports maintain the floor in the correct orientation and position i.e., parallel to and level with the core floor. A well known wood plate (not shown), which is illustratively comprised of a pair of 2"×6" studs laid one atop another, is affixed all around the top surface of this foundation. These studs and the foundation are configured and arranged so as to facilitate the unfolding of the structure. Thereafter, the folded house shown in FIG. 1 is positioned on top of the wood plate and unfolded in a manner discussed below.

Figure 2:
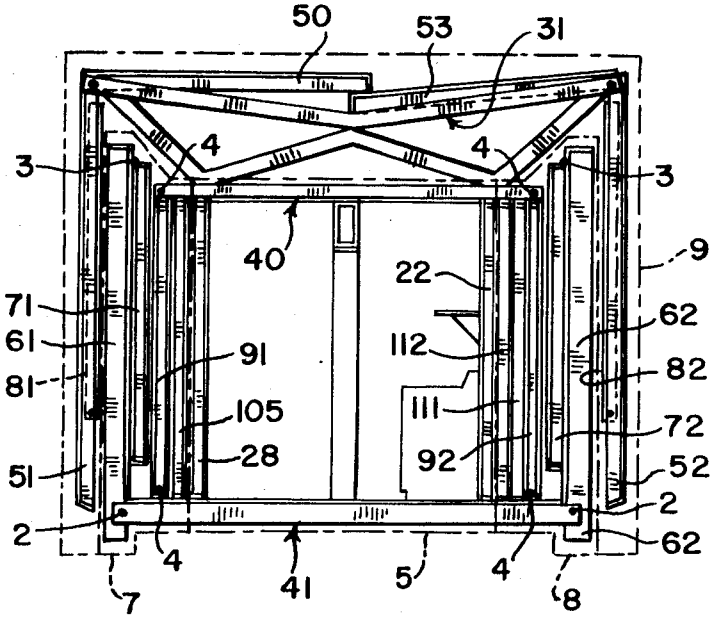
FIG. 2 is a cross-sectional view of applicant's prefabricated folding structure shown in FIG. 1.

FIG. 2 depicts a cross-sectional detail view of the prefabricated folding house of FIG. 1 taken through a section generally resembling 2—2 of FIG. 10. Viewed in conjunction with FIG. 1 and the interior plan view shown in FIG. 10, FIG. 2 shows that applicant's folding house is comprised of a rectangularly shaped central core 5, a plurality of folding exterior wall members—specifically folding front wall 71, folding rear wall 72 and folding side walls 91, 92, 93 and 94; and pivoting floor sections 61 and 62; folding roof 9 containing folding upper and lower roof section 50 and 53, and 51 and 52, respectively; and pivoting ceiling members 81 and 82, and lastly a plurality of prefabricated roof trusses of which only truss 31 is shown.

Specifically, central core 5 is comprised of interior core walls 22, 23, 24, 26, 27 and 28, and exterior core walls 21 and 25 all secured, illustratively, by nails to both core floor 41 and ceiling member 40. The central core is completely prefabricated and contains all piping, plumbing, and electrical control means (i.e.—circuit breaker box, etc.) for connection to external sources of supply (i.e. water, gas, electricity, etc.). Also, all necessary systems for the entire structure, e.g. heating, plumbing and electrical, and all the required appliances and plumbing fixtures are installed in the central core during prefabrication. Furthermore, any outlets that are to be located in any of the pivoting members, particularly the walls, are installed while the structure is being prefabricated.

As shown in FIG. 10, this core contains the kitchen including all its appliances; the bathroom—including the necessary plumbing fixtures, noteably a bathroom sink, tub/shower and toilet; and a closet with folding doors containing the hot water heater, washer and dryer.

Preferably, the core walls each comprise a plurality of studs and at least two plate members connected respectively to the top and bottom of the plurality of studs. Since these core walls are located within the folded structure, they are provided with gypsum board after the necessary piping, plumbing, and electrical components have been installed. An advantageous stud is a wooden 2"×4", although steel, aluminum, or other materials could be used, if desired.

Each pivoting exterior wall (front wall 71, rear wall 72 and side walls 91, 92, 93 and 94) is completely assembled during pre-fabrication. These walls would be constructed in the same manner as the core walls. One difference, however, is that these walls would each have one side facing the exterior of the building. These faces would then be covered with a sheathing, moisture barrier, and finally, the desired exterior facade.

Each wall is specifically fabricated from illustratively 2"×4"×8 foot wooden studs which are approximately spaced 16" apart on a center-to-center basis. During prefabrication, windows are installed at predetermined locations into these walls, and the exterior surface of each folding wall, i.e., that surface which faces the outside environment, is covered with standard ½" plywood sheathing material over which a moisture barrier along with the desired siding material, e.g. aluminum siding, asbestos shingle or other siding material, is applied. In addition, electrical outlet boxes are affixed to various studs in these walls and wired at the factory. To conform with standard building codes, all electrical wiring is placed inside each wall. Thereafter, thermal insulation is installed within each wall and illustratively ½" gypsum board, (also known as "dry wall" or "sheet rock") is then installed over the interior surface of each folding exterior wall, with an appropriately located prewired electrical outlet.

As previously discussed, means for supporting the roof and ceiling of the structure are provided above the central core. These means are located on and are supported by the common walls of the core, and preferably comprise a plurality of prefabricated truss assemblies. Each of the prefabricated trusses provide the necessary structural support for the upper and lower folding roof sections whenever they are pivoted into an open, i.e. unfolded, position. While only one truss 31 is shown in the cross-sectional view of FIG. 2, the house is illustratively comprised of a number of separate trusses, each preferably fabricated from 2"×4" rafters and mounted on a 24" center to center spacing. Any number of trusses can be used, with the particular number being predicated upon the desired spacing between trusses and the size of the structure. The spacing for the trusses (and also for the floor joists, wall studs and ceiling rafters) is often specified by local building codes and/or practice and can thus vary from that specified hereinbelow. Each truss is pivotedly attached to upper roof sections 50 and 53, and lower roof sections 51 and 52 of roof 9.

As shown in FIGS. 2 and 10, a number of structural members, including pivoting exterior side and front (and rear) walls and a pivoting floor member, are positioned during prefabrication substantially parallel to and alongside the interior core walls. Specifically, these structural members are arranged in two groups of similar members, group 7 being adjacent to interior wall 28 and the other, group 8, being adjacent to interior wall 22. In the shipping configuration shown in FIG. 2, the structural members comprising each group are positioned alongside each other and are all substantially parallel to the adjacent interior core wall 22 or 28. Group 7 is comprised of free-standing partition 105, folding exterior side wall 91, folding exterior front wall 71 and pivoting floor section 61, and also—as is apparent from FIG. 10—folding interior walls 101–104 and folding exterior side wall 94. Group 8 is comprised of similar structural members and free-standing partitions, specifically: folding exterior side walls 92 and 93, folding exterior rear wall 72, pivoting floor section 62, folding interior walls 108–112 and free standing partitions 106 and 107. It should be noted that interior walls 101 and 102 are joined together, but are provided with an open area in between for access (i.e., a doorway). The same applies to wall 103 and 104; 108 and 110; and 109 and 111.

In accordance with this feature of the invention, substantial closet space is incorporated into the folding structure through the use of the folding interior walls and free-standing partitions. When the structure is fully folded, these interior walls and partitions are initially positioned to lie alongside various interior side walls comprising the central core. Once the walls and floor members are pivoted into their properly installed positions, an enclosed area is defined around the core. Each pivoting interior wall and each free-standing partition are then pivoted or moved to a pre-determined position within this area in order to define all the rooms arranged about the core and all the closets existing therein.

Folding the Structure

The shipping configuration, shown in FIG. 2, is achieved during prefabrication by first appropriately pivoting the folding interior walls and positioning the free-standing partitions against the core walls and second folding i.e., pivotedly positioning, various structural members inwardly about the central core in the manner described below. Since the structural members comprising group 8 both pivotedly interconnect and fold in a nearly identical manner to those comprising group 7, the following sequence will be described, for the sake of brevity, with respect to only those members in group 7.

Figure 12:
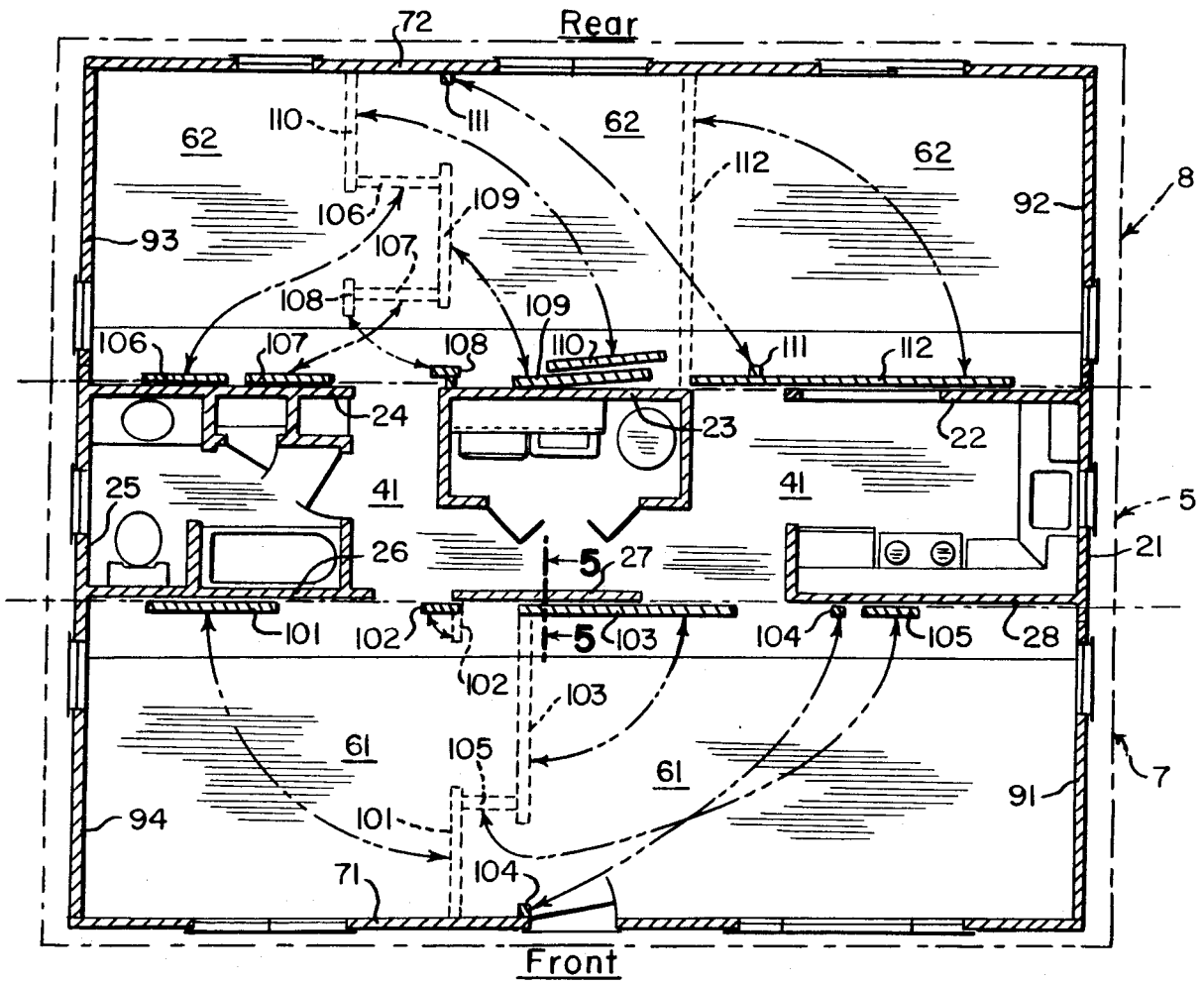
FIG. 12 is a plan elevational view of the interior of applicant's prefabricated folding structure, depicting the positioning of folding walls 101–104 and 108–111, and free-standing partitions 105, 106, and 107.

First, free-standing partition 105 is positioned, as shown in FIG. 12, alongside interior side core wall 28. This partition is preferably oriented such that its vertical edges are parallel to those of the interior core wall. In a similar fashion, folding interior walls 101–104 are pivoted and positioned, as shown in FIGS. 10 and 12, such that each lie alongside interior side core walls 26 and 27.

Figure 11:
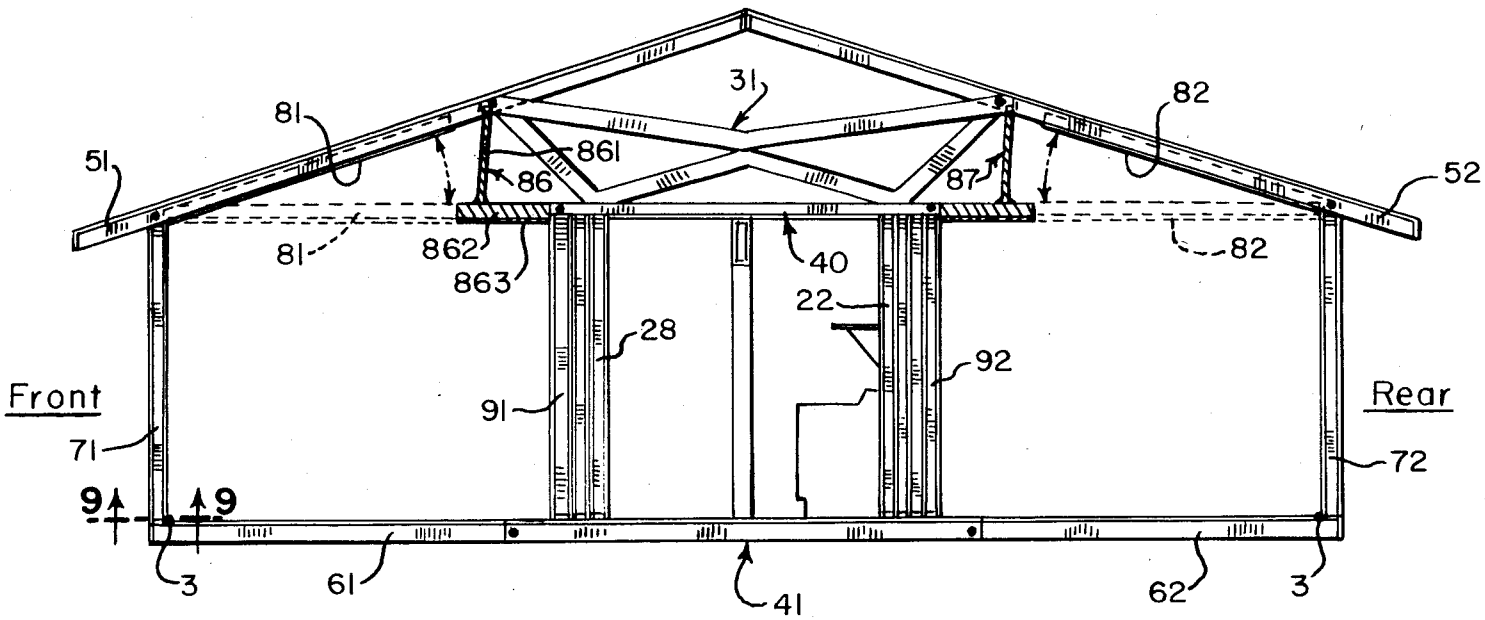
FIG. 11 is a cross-sectional view of applicant's prefabricated folding structure, depicting the pivotal movement of folding ceiling sections 81 and 82 and ceiling support T-braces 86 and 87.

Thereafter, folding ceiling members 81 and 82 are each pivotedly positioned upwardly, as shown in FIG. 11, such that each folding ceiling member, e.g. ceiling member 81, lies partially within and parallel to a corresponding lower folding roof member, e.g. folding roof member 51. The rafters in each folding ceiling member are staggered with respect to those in each corresponding lower folding roof member such that when those ceiling members are folded their joints partially interleave with those in each corresponding lower roof folding section.

Next, as shown in FIG. 10, folding exterior side walls 91 and 94 are pivotedly positioned inwardly, about pivots 4, such that these walls lie alongside free-standing partitions 105 and pivoting wall 101, respectively. Then, as is evident from FIG. 8, folding exterior front wall 71, which pivots, via one of the pivots 3 about an end of pivoting floor section 61, is pivotedly positioned downward, such that it lies alongside pivoting floor section 61.

Figure 7:
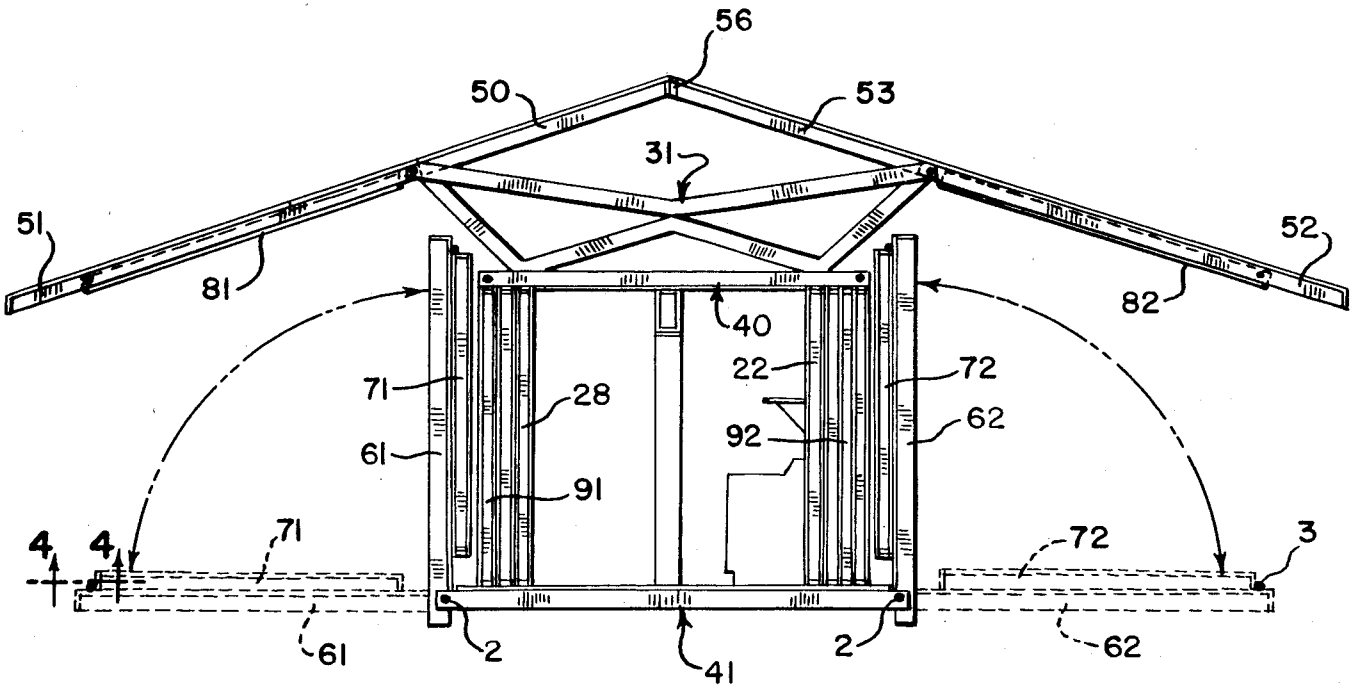
FIG. 7 is a cross-sectional view of applicant's prefabricated folding structure, depicting the pivotal movement of folding floor members 61 and 62.

Thereafter, as shown in FIG. 7, pivoting floor section 61 is pivoted upward about pivot 2 located in the left end of core floor 41, such that folding exterior front wall 71, particularly its exterior surface, lies alongside folding exterior side wall 91 (and 94 not shown).

Figure 6:
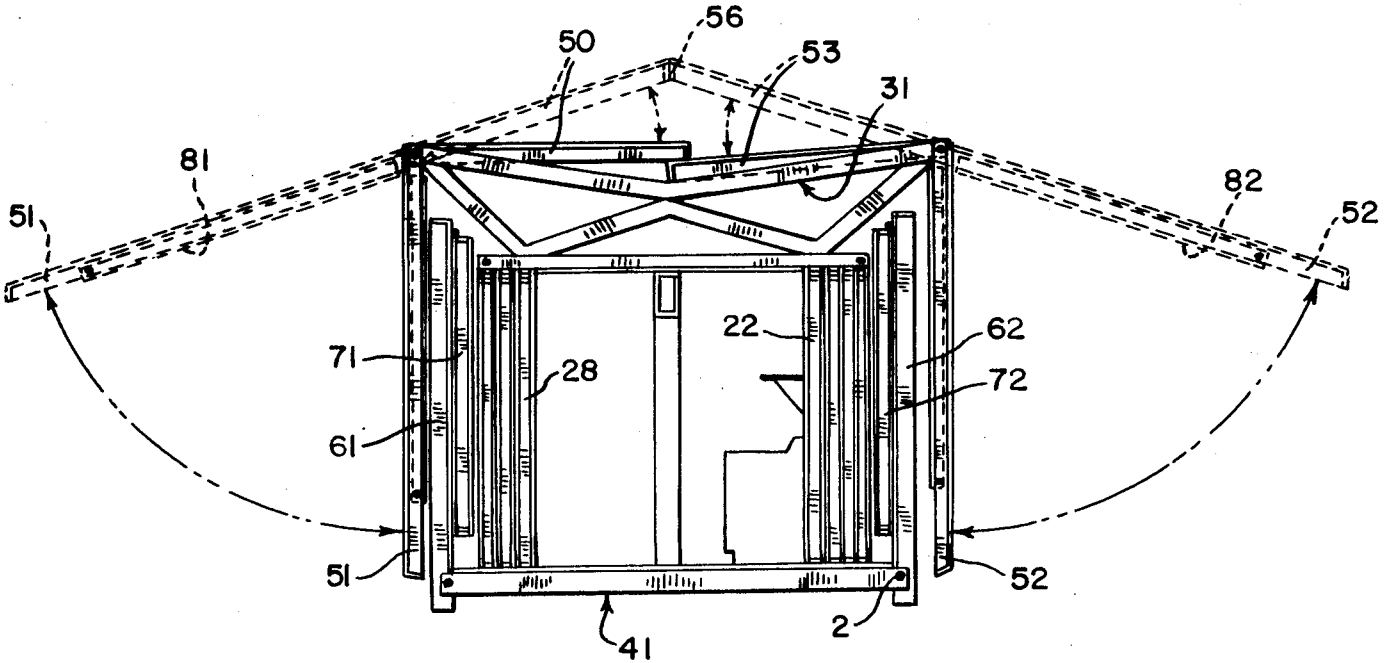
FIG. 6 is a cross-sectional view of applicant's prefabricated folding structure, depicting the pivotal movement of upper folding roof sections 50 and 53, and lower folding roof sections 51 and 52.

Now, with all the exterior folding walls folded inwardly about the core, upper folding roof section 50 and 53 are folded, as shown in FIG. 6, by being pivotedly positioned downward until each abuts against all the trusses, e.g. truss 31. Lower folding roof sections 51 and 52 are then folded by being pivotedly positioned downward and inwardly such that each lies vertically alongside folded floor members 61 and 62, respectively.

Pivots between Folding Structural Members

Figure 3:
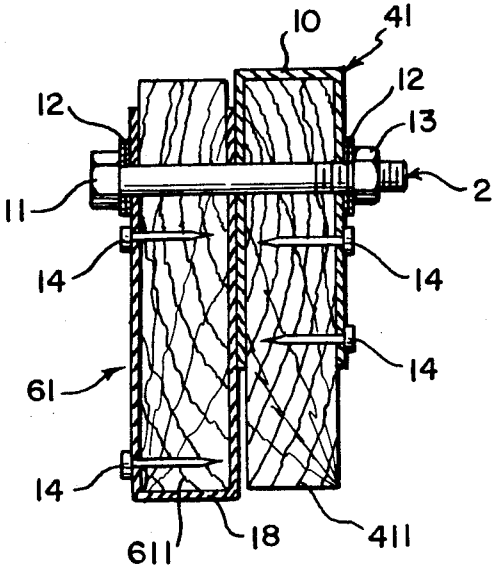
FIG. 3 is a cross-sectional view of pivot 2 shown in FIG. 2 and taken through section 3—3 of FIG. 8.

Pivot 2 exists between folding floor members 61 and 62 and core floor 41. This pivot is comprised of a plurality of identical pivoting assemblies, each connecting a floor joist in the central core to a corresponding floor joist in either of the folding floor members. For purposes of illustration, one such pivoting assembly, i.e. that each such existing between floor joist 611 of pivoting floor section 61 and floor joist 411 of central core floor member 41, is shown in FIG. 3.

This pivot 2 comprises pivoting means for rotation of the pivoting floor section with respect to the central core floor, means for transferring the load from the pivoting floor section to the central core floor. This pivot also includes the means for reducing frictional forces during rotation of the pivoting floor section.

The load transferring means preferably is a metal saddle strap, while the friction reducing means is a metal washer. Also, the saddle strap functions to partially reduce friction between the two support members. The pivoting means is preferably bolting means or the like.

Specifically, this pivoting assembly is comprised of bolt 11 (illustratively a ½" ASTM A307 bolt) secured by washers 12 and nut 13. Separate saddle straps 10 and 18, each preferably fabricated from galvanized metal 12 gauge or thicker, are each nailed to a floor joists 411 and 611 respectively, in the vicinity of the pivot. These straps provide a sliding interface against which each joist can rotate without causing any abrasion of either joist. After floor section 611 has been appropriately pivoted into its unfolded position, nut 13 is completely tightened to secure pivoting floor section 61 in position.

Figure 4:
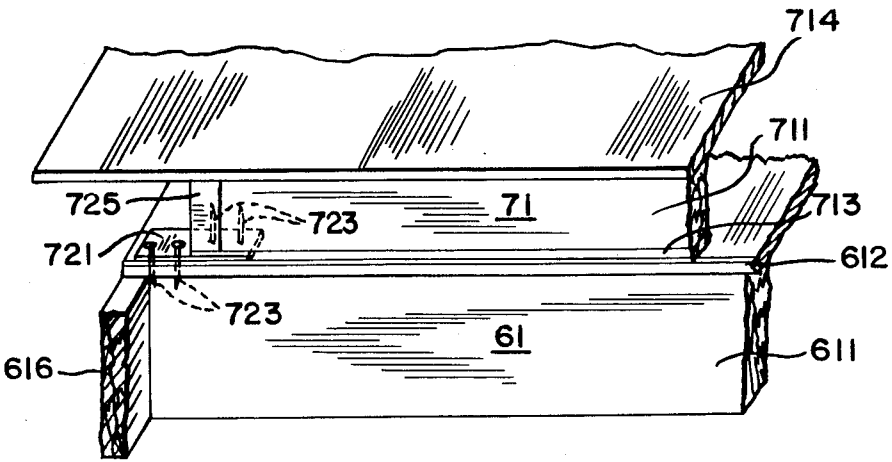
FIG. 4 is a partial cross-sectional view of one of pivots 3 shown in a folded position and taken through section 4—4 of FIG. 7.

Pivot 3 exists between pivoting floor section 61 and folding exterior front wall 71 and between folding floor member 62 and folding exterior rear wall 72. This pivot is comprised of a plurality of identical pivoting assemblies, each connected between every joist in a pivoting floor section and every wall stud in a pivoting exterior front or rear wall. A partial cross-sectional view of one of these pivoting assemblies, i.e. that existing between floor joist 611 of folding floor member 61 and wall stud 711 of pivoting exterior front wall 71 is shown in FIG. 4.

This pivot 3 includes pivotal means connected to the pivoting floor and pivotable wall members. The pivoting means comprises an elongated member which is foldable along a predetermined crease line. This member has sufficient strength to hold its shape and requires a predetermined force to be moved or bent. This elongated member facilitates changing the position of the wall members relative to the floor from a generally parallel initial position to a predetermined final or unfolded position. Preferably, this final position has the wall members substantially perpendicular to the floor.

Also, after the wall members are rotated to the desired angle, the pivoting means is capable of retaining the wall in relative position with respect to the floor. Although the pivoting means are capable of conforming to any angle between 0 and 180 degrees, in the most advantageous embodiment, the wall is rotated 90° and the pivot maintains the wall in this position without the use of other restraining forces.

Specifically, the pivoting assembly is comprised of a metal plate 721, which is nailed to both floor joist 611 and wall stud 711 by illustratively four nails 723, sized 10 penny (10 d) common or larger. Two of these nails are driven through the plate and subfloor 612 into floor joist 611, and the remaining two are driven through the plate and gypsum board 713 into wall stud 711. Whenever exterior front wall 71 is fully pivoted upward into position, as discussed later in conjunction with FIG. 9, exterior front wall 71 is oriented perpendicular to pivoting floor section 61 and, as a result, metal plate 721 is bent by the pivoting movement of the folding wall with respect to the folding floor into an "L" shape. This plate is advantageously fabricated from galvanized steel or other material that is sufficiently thick, preferably 16 gauge or wider, such that all the plates alone can hold the wall in an upright perpendicular position and also undergo many bending and unbending operations without showing any signs of stress or fracture.

Pivot 4 includes pivotal means attached to the wall member, the core ceiling and the core floor. The pivotal means comprises means to rotate the wall member to a predetermined angle around the axis of the pivotal means. Also, the pivotal means are positioned and oriented so as to facilitate rotation of the wall member while minimizing the space between the wall member and core wall when the wall member is in an unfolded or open position.

Preferably, the pivotal means comprises two nails; one between the ceiling and wall, and the other between the floor and wall. These nails are placed slightly off center to facilitate rotation of the wall while minimizing the space between the core wall and rotated wall member.

Figure 5:
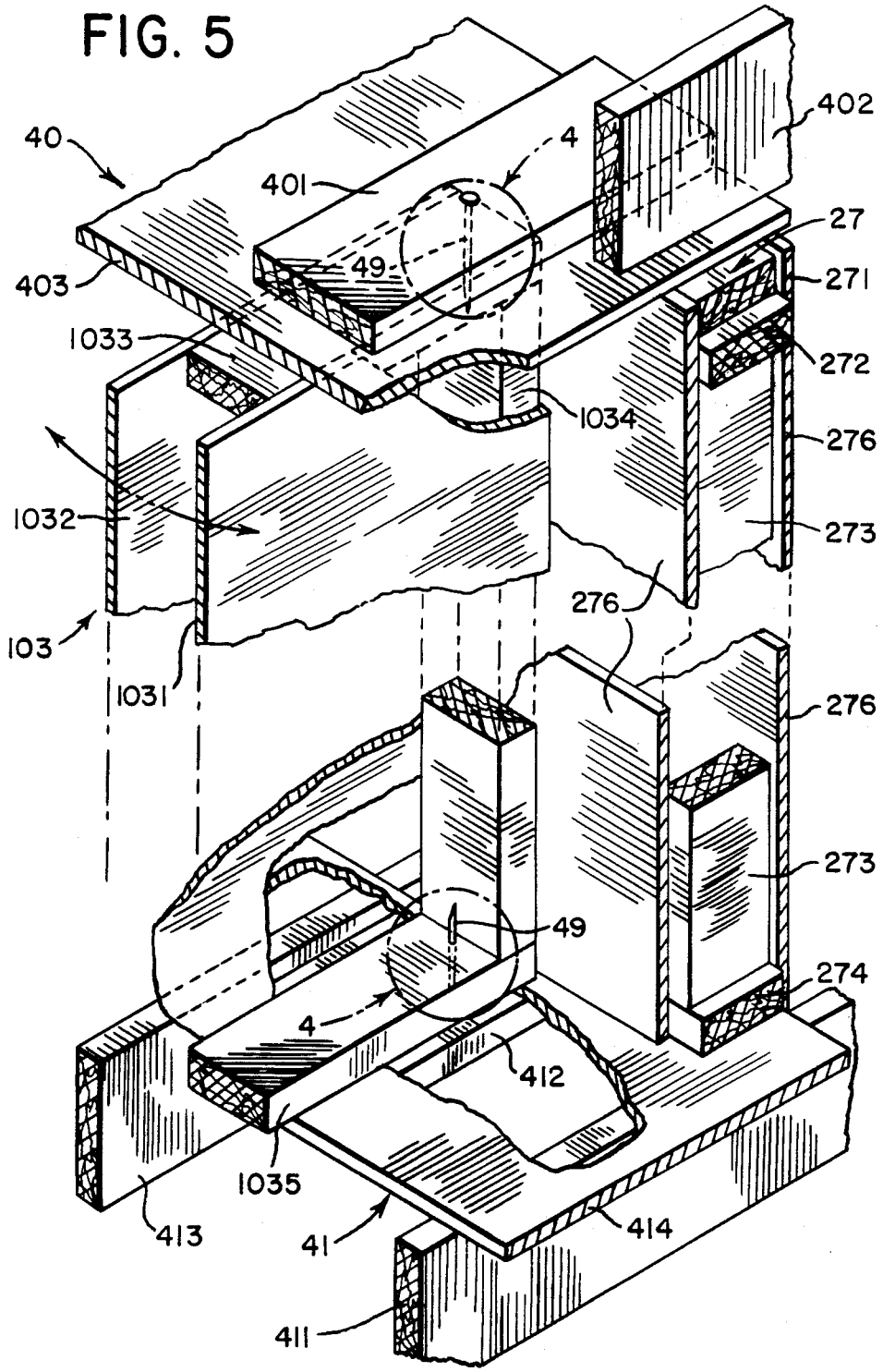
FIG. 5 is a cross-sectional view of one of pivots 4 shown with interior wall 103 completely pivoted and taken through section 5—5 of FIG. 12.

FIG. 5 illustrates pivot 4. Interior wall 103 is pivotedly attached, as shown, to core floor 41 and ceiling member 40 by two nails 49. Each of these nails is sized preferably 16 penny (16 d) common or larger. One nail is driven through cat block 401 in its upper wall member 1033 and the other is driven through cat block 412 into lower wall member 1035. Cat block 401 is secured by nails (not shown) to two adjacent ceiling joists—of which only joist 402 is shown. Cat block 412 is secured by nails (not shown) to adjacent floor joists 411 and 412. Consequently, interior wall 103 rotatably pivots about nails 49.

FIG. 5 also shows interior wall 103 in a completely folded configuration (as shown in phantom in FIG. 12). Pivoting interior wall 103 is comprised of a sequence of illustratively standard dimension 2"×4"×8' wooden studs—of which only stud 1034 is shown—arranged with approximately 16" center to center spacing and nailed to both upper wall member 1033 and lower wall member 1035. A layer of gypsum board 1031 is affixed to each exterior side of this folding wall 1033.

Core floor 41, as shown and as previously discussed, is comprised of illustratively 2"×10" wooden floor joists—of which only floor joists 411 and 413 are shown—all arranged with an approximate 16" center-to-center spacing. Subfloor 414—illustratively $\frac{5}{8}$" plywood sheet—is nailed to the core floor joists. Ceiling member 40 is constructed in a similar manner as is core floor 41, with the exception that gypsum board, specifically sheet 403, instead of $\frac{5}{8}$" plywood as used in the subfloor, is nailed to the under surface of the 2"×4" ceiling beam—of which only beam 402 is shown.

When fully unfolded, interior wall 103 lies substantially perpendicular to interior core wall 27. This core wall is comprised of a sequence of 2"×4"×8' studs—of which only stud 273 is shown—arranged on an approximate 16" center to center spacing and nailed to both top wall members 271 and 272 and lower wall member 274, all of which are also illustratively 2"×4"×8' wooden studs. Gypsum board 276 is affixed to both sides of interior core wall 27.

Pivots 4 exist between core ceiling 40 and folding exterior side walls 91, 92, 93 and 94, and between core floor 41 and folding exterior side walls 91, 92, 93, and 94. All pivots connecting each folding exterior side wall to the core ceiling and core floor are identical, and would be similar to the pivot 4 illustrated in FIGS. 5. For the exterior side walls, however, the central core side walls 21, 25 are extended as shown in FIG. 10 provide enough space for the non-pivoting members, such as partition 105, "T-braces" 86, etc.

Unfolding the Structure

Having summarily described the sequence in which the pivoting walls, floor and roof members fold inwardly about the central core to form the folded structure shown in FIGS. 1 and 2, a more detailed explanation will now be given as to the manner in which all the structural members are sequentially unfolded to transform the house from its shipping, i.e., folded, configuration into a fully habitable residential dwelling. This sequence is depicted in FIGS. 6 through 8, and 10 through 12.

The first structural members to be unfolded are the roof sections. As shown in FIG. 6, upper folding roof sections 50 and 53 are pivotedly positioned upward and outward. Ridge beam 56 is preferably a 2"×6" wooden beam which runs the entire length of upper folding roof section 53 and abuts against the top edge of folding roof section 50 when both these roof sections are completely unfolded. The rafters that comprise each of these upper roof sections are 2"×4" wooden beams located on a 24" center-to-center spacing, and all the rafters comprising either of the upper roof sections are staggered with respect to those of the other. Once these upper roof sections are completely unfolded into position as shown in FIG. 6, a pair of suitably sized nails (not shown), preferably 16 penny (16 d) common or larger, are driven through the ridge beam and into each rafter comprising upper folding roof section 50 in order to fully secure both upper roof sections in position. It should be noted that all upper roof sections have been fully sheathed and shingled during prefabrication.

Next, as shown in FIG. 6, lower roof sections 51 and 52, each comprised of illustratively 2"×4" rafters are pivoted upward and outward into position. These rafters are connected by pivotal means comprising bolting means. Each pivot connecting both the upper and lower roof sections to the trusses, is comprised of a series of $\frac{1}{2}$" bolts (not shown), each of which runs through a rafter in a lower roof section, an adjacent truss and an adjacent rafter in upper roof section. A temporary support (not shown) is then positioned under the lower end of each of these lower folding roof sections and is adjusted to an appropriate height to temporarily keep each lower roof section in its completely unfolded position. To secure the roof sections in a final position, a properly sized nut which has been threaded onto the end of each bolt is fully tightened. In addition, at least three nails, preferably 16 penny (16 d) common or larger, are then driven through each rafter in the lower roof section and into its adjacent roof truss, and likewise, three more of these nails are driven through each rafter in the upper roof section and into its adjacent roof truss. Again all lower roof sections have been fully sheathed and shingled during prefabrication.

Once the roof is completely unfolded, then as shown in FIG. 7, folding floor member 61 and 62 are pivoted into position. Specifically, both folding floor members are pivoted downward and away from the central core, thereby forming the entire floor for the dwelling.

Figure 8:
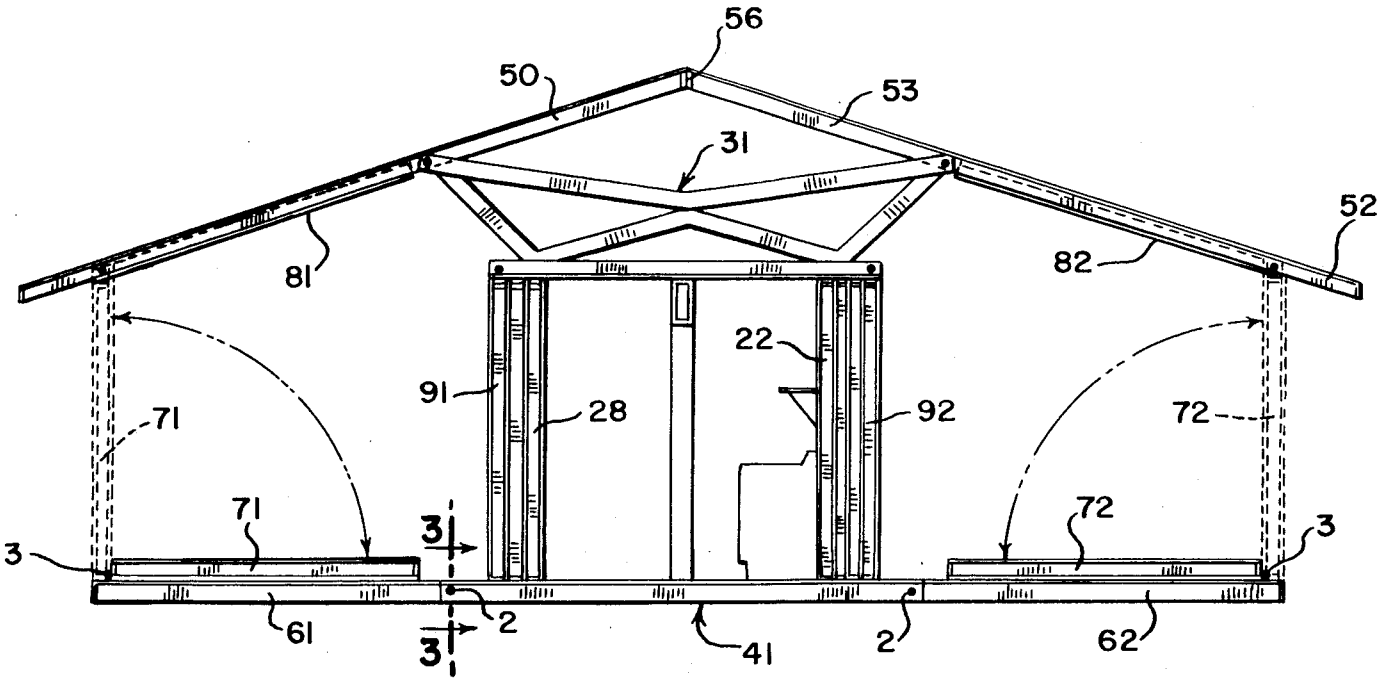
FIG. 8 is a cross-sectional view of applicant's prefabricated folding structure, depicting the pivotal movement of folding front and rear exterior walls 71 and 72, respectively.

Thereafter, as shown in FIG. 8, folding exterior front and rear walls 71 and 72 are unfolded into position. Specifically, each wall is pivoted upward and outward about pivots 3 until the upper ends of exterior front wall 71 and exterior rear wall 72 abut against all the rafters comprising lower folding roof sections 51 and 52, respectively.

Figure 9:
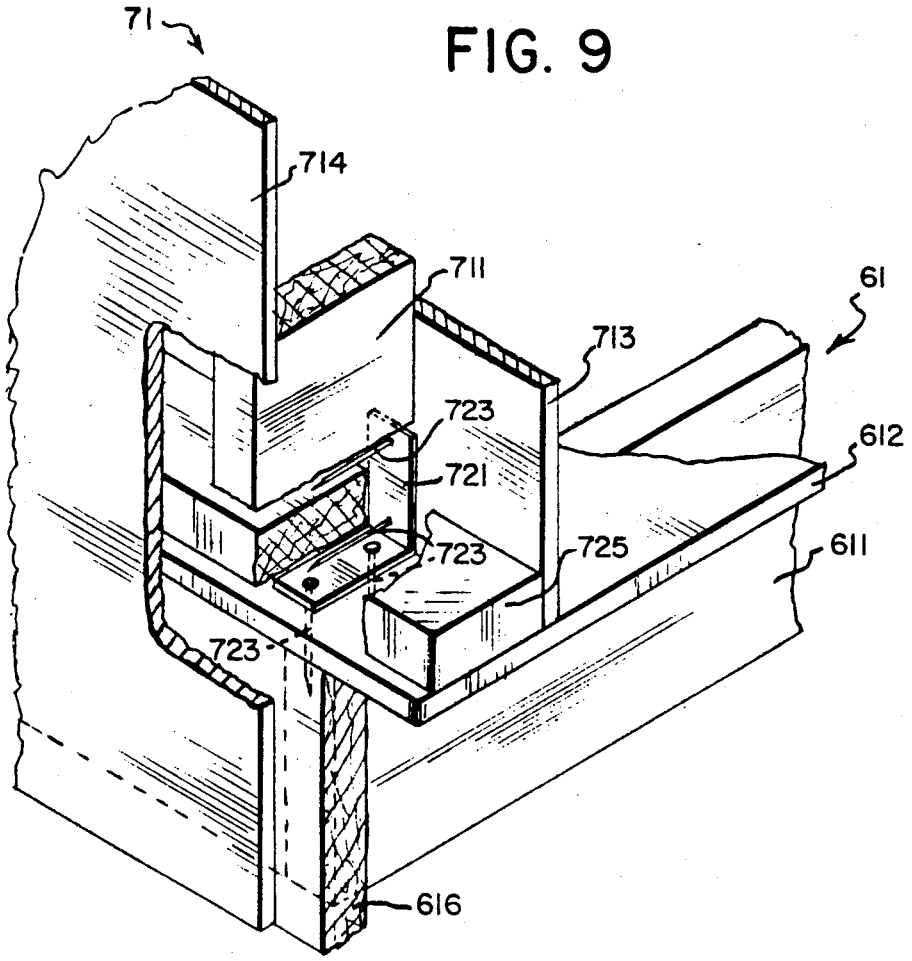
FIG. 9 is a partial cross-sectional view of one of pivots 3, shown in a completely unfolded position and taken through section 9—9 of FIG. 11.

As can be seen in FIG. 9 and as previously noted in conjunction with FIG. 4, the upward movement of folding exterior front wall 71 away from pivoting floor section 61 causes metal plate 721 to become "L-shaped". Whenever folding exterior front wall 71 is fully unfolded, horizontal stud 725, which exists at the bottom of this wall, lies on top of subfloor 612 of pivoting folding section member 61. In this position, exterior sheathing 714, which is illustratively $\frac{1}{2}$" plywood sheet and which has been attached to this wall during pre-fabrication, overhangs subfloor 611 and end piece 616. This endpiece is nailed to each of the floor joists, by at least 3 nails, preferably 10 penny common or larger, which are all nailed through the sheathing and into the endpiece in the vicinity of each floor joist.

With these folding exterior front and rear walls, secured in place, folding exterior side walls 91, 92, 93, and 94, as shown in the plan view of FIG. 10, are then unfolded into position and secured in place. Specifically, each exterior wall is pivoted outwardly about pivots 4—as previously discussed and shown in FIG. 5—such that each end wall lies substantially perpendicular to the previously unfolded exterior front or rear walls. Once each folding exterior side wall is pivoted into its properly unfolded position, screw nails (not shown but well known) are driven through appropriately positioned cat blocks existing between respective adjacent ceiling rafters and floor joists into the header and lower crosspiece of each of these walls.

At the end walls of the house, the ceiling and lower roof section are pivotally joined. The pivotal means utilized for this connection comprises means for rotation of the ceiling member with respect to the roof member, and means for attaching the ceiling and roof member to the outer wall member.

At this juncture, folding ceiling members 81 and 82, as shown in FIG. 11, are unfolded into position. To accomplish this, folding ceiling members are pivoted downward such that unfolded ceiling member 81 lies on top of unfolded exterior front wall 71 and side walls 91 and 94; and unfolded ceiling member 82 lies on top of exterior front wall 72 and side walls 92 and 93, respectively.

Next, unfolded exterior front wall 71 is secured to unfolded ceiling member 81 and to lower folding roof section 51. A plurality of "L-shaped" double nailing plates (not shown but well-known) having a saddle shaped lower extension are positioned such that the saddle of each nailing plate straddles the header of folded exterior front wall 71. Each nailing plate has an upward vertically oriented section emanating from one end of the saddle, and is positioned along the header such that its vertical section abuts against one of the rafters in the lower roof section. There are as many nailing plates positioned along the header as there are rafters in this roof section. Once a plate is appropriately positioned, it is nailed to both the header—using preferably at least 6 nails sized 10 penny (10 d) common or larger, with two nails driven through the saddle of the plate into each side of the header and the remaining two nails driven through the vertically oriented section in the lower roof rafter. To further secure the unfolded exterior front wall to the lower roof section, a bolt and not assembly (not shown) preferably ½" diameter, which has been inserted through a pre-drilled hole existing in the vertical section in each nailing plate and into a corresponding hole in the adjacent lower roof rafter during prefabrication, is tightened. Appropriate size washers may be used with each bolt. Unfolded exterior rear wall 72 is secured to lower folding roof section 52 in a substantially identical fashion.

Since adequate support for the lower roof members is now provided by all the unfolded exterior walls, the jacks that are supporting these lower roof sections are now removed.

Additional support for folding ceiling members 81 and 82 is provided by the installation of a number of "T-braces" as shown in FIG. 11. In the illustrative embodiment shown and described herein, one T-brace, is mounted to a respective upper end of each truss and supports each ceiling member. The number of "T-braces" depends ultimately upon the number of trusses used. Each T-brace extends downward from a side of a upper end of a roof truss and lies in line with a corresponding rafter in a folding ceiling member, and provides a surface upon which the desired ceiling materials can be installed.

Since all the T-braces are approximately the same, for purposes of illustration, only T-braces 86 and 87 which run between truss 31 and folding ceiling members 81 and 82, respectively, are shown, and only T-brace 86 is discussed. T-brace 86 is comprised of an appropriate length of 2"×4" stud, e.g. stud 861, which extends downward from an appropriate, truss to a ceiling rafter, and a relatively short length of 2"×4" stud, e.g. stud 862, which is positioned perpendicularly to stud 861.

A nailing plate (not shown but well known), fabricated from galvanized 16 gauge or larger metal sheet and having a saddle at one end and a flat nailing surface at the other, can be used to secure the T-brace to the header in ceiling member 81. This plate is positioned to straddle the header such that its flat nailing surface abuts against a side surface near one end (the left end) of stud 862. The plate is then nailed to both the header and T-brace 86 using preferably 6–10 penny (10 d) common or larger sized nails; four of these nails secure the nailing plate to the header and the other two secure the nailing plate to the brace. In a similar fashion, an identical nailing plate can be used to secure the other end of this "T-brace" to a wooden crosspiece existing at the right end of core ceiling 40.

Preferably the "T-brace" can be fabricated by two 2"×4" studs oriented perpendicular to each other and merely nailed together. This method enable scrap wood to be used and is more cost effective than using nailing plates.

These "T-braces" are used to carry the ceiling loads. They are nailed to the core wall and ceiling members. Then, the weight of the roof is transferred through the "T-brace" to the other members.

Once each "T-brace" is appropriately positioned, it is then secured in position by nails, preferably 16 penny common or larger, driven through its upper end and into the adjacent truss. After all the "T-braces" have been secured, a rectangular sheet of gypsum board, e.g. sheet 863, is nailed to the lower surface of the wooden nailing plates. Each sheet is appropriately sized to both lie flush against the gypsum board previously affixed to the ceiling members during prefabrication and to completely fill in the rectangular opening occurring between the gypsum boards on the underside of each folding ceiling member and the underside of the central core ceiling. All these "T-braces" are completely fabricated during prefabrication of the house and are temporarily stored on the central core floor during shipment of the folded house to the building site.

Once the folding ceiling members have been fully unfolded and secured in position, an enclosed area is defined about this central core. Then, as shown in the plan view of FIG. 12, folding interior walls 101–104 and 108–112, and free-standing partitions 105, 106, and 107, are pivoted or moved into respective positions in this area to define both the rooms arranged about the central core and all the closets contained therein. Specifically, folding interior walls 103 and 112 pivot in the same manner as does exterior side wall 92 shown in FIG. 5 and discussed hereinabove. Once the folding interior walls are pivoted into position, then each free-standing partition is appropriately positioned in place. The folding interior walls and partitions are completely framed and covered with gypsum board during prefabrication. Once in position, each of these interior walls and partitions are secured by screw nails to the floor joists in pivoting floor sections 61 or 2, and to the rafters in ceiling members 81 and 82. Specifically these nails are driven through appropriately positioned cat blocks, existing between certain adjacent rafters in the ceiling (and between certain selected joists in the folding floor members), and into the top (and bottom) horizontal studs comprising each of these interior folding walls and partitions. Advantageously, the use of free-standing partitions, which are positioned during on-site installation, to define room sizes and closets, readily permits changing the dimensions of these rooms and closets at any time up to installation without incurring much, if any, expense. While the doors to each of the closets formed by the free-standing partitions, as well as a number of interior room doors, have all been omitted for the sake of clarity from the plan views shown in the drawing, these doors are attached, i.e. pre-hung, to corresponding pivotal walls or free-standing partitions and interior core walls during prefabrication. Advantageously, this further reduces on-site installation time and expense.

Figure 13:
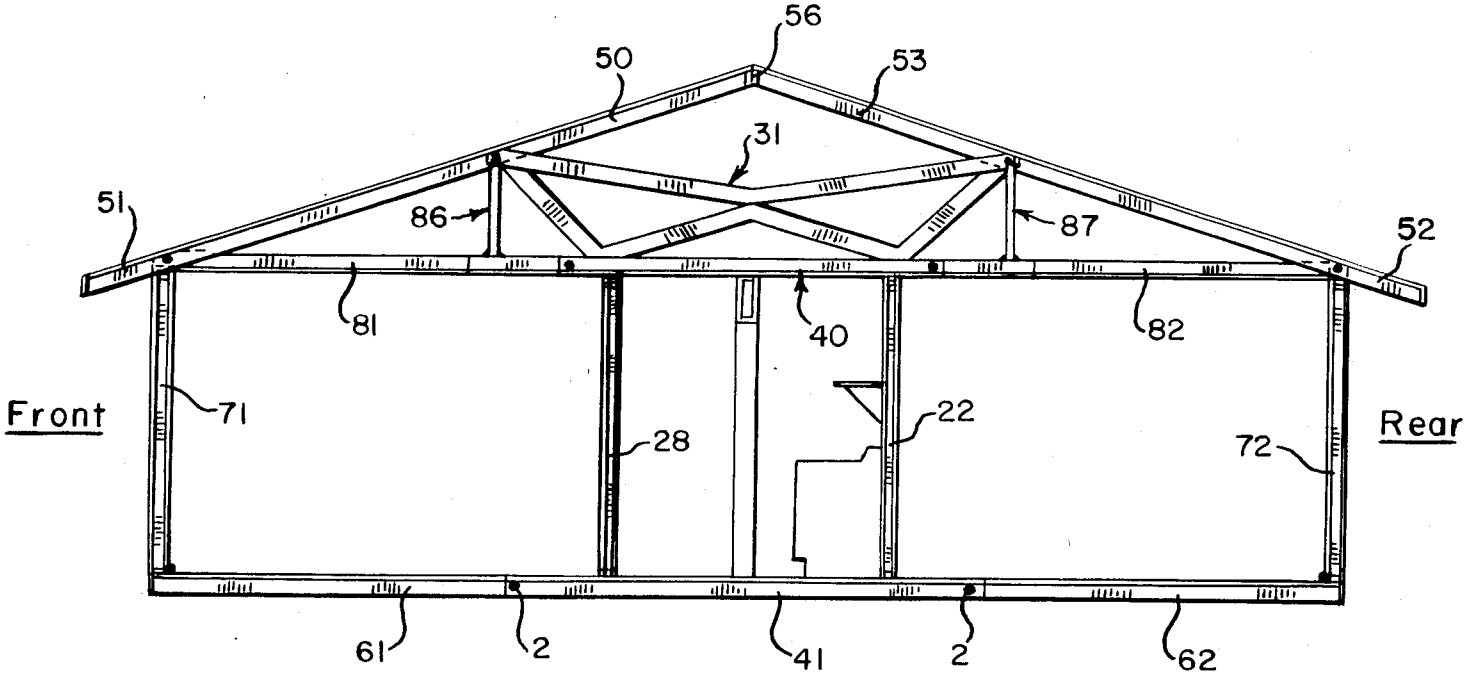
FIG. 13 is a cross-sectional view of applicant's prefabricated structure, shown completely unfolded.

As should be readily apparent, applicant's folding prefabricated house is now completely unfolded. A cross-sectional view of it is shown in FIG. 13.

Figure 14:
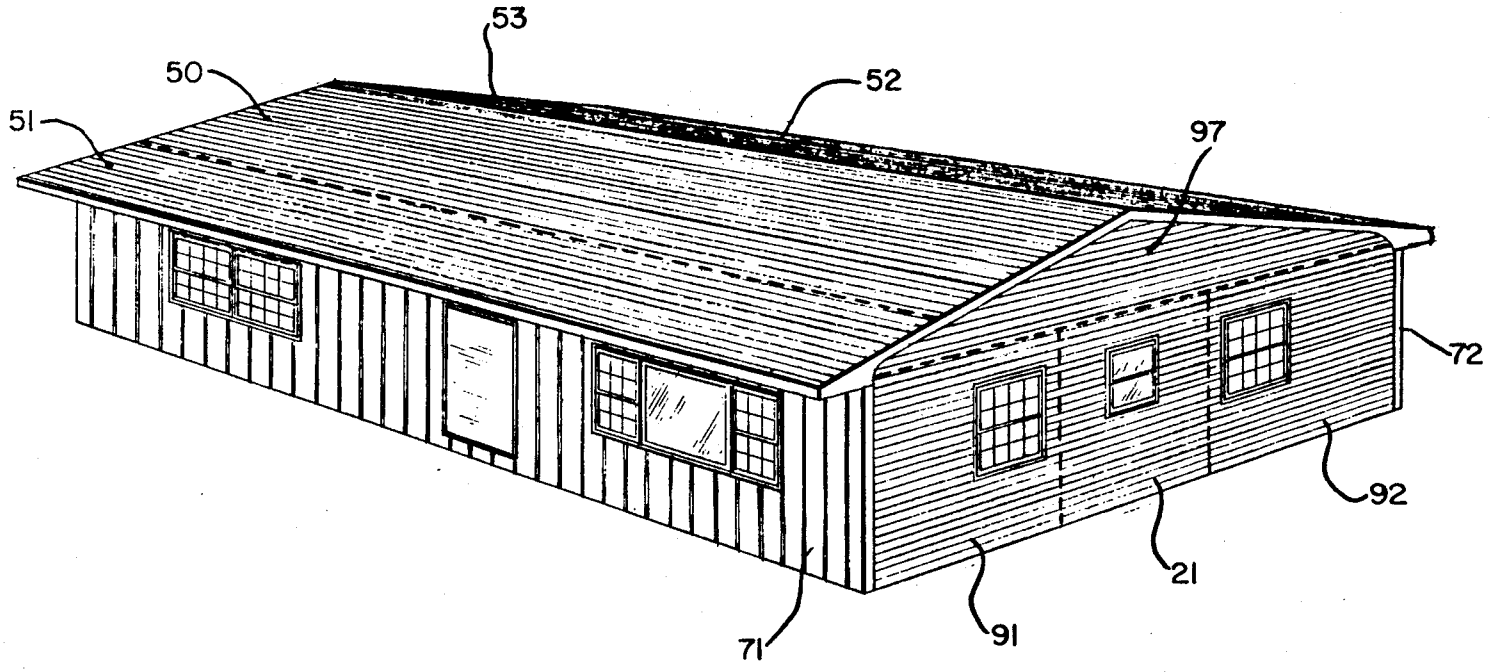
FIG. 14 is an exterior perspective view of applicant's prefabricated structure shown completely unfolded and installed on-site.

At this stage of installation, the only portion of the dwelling that remains to be enclosed is the attic. To accomplish this, a prefabricated gable end is nailed to the outermost roof rafters and ceiling beams existing at each side of the dwelling. Specifically, each of the two gable ends, of which only gable end 97 is shown in FIG. 14, is triangularly shaped and is comprised of a series of 2"×4" studs (not shown) of appropriate length and mounted apart from each other on an approximate 16" center to center spacing. A layer of sheathing (not shown), preferably ½" plywood, is installed over these studs during prefabrication at the factory. After the gable ends are installed on-site, appropriate siding material, e.g. aluminum or shingle, is applied to the entire side of the house including the gable ends. Applying this type of siding in the field advantageously minimizes the likelihood that any mis-alignment between the siding on the gable ends and that on the rest of the exterior side walls will be visible. If, however, cedar shingles are used for siding, then any minor mis-alignment between the siding attached to the gable ends and that attached to the rest of the exterior side walls is generally not visible. Consequently, this siding material can be applied during prefabrication to both the gable ends and to all the folding exterior side walls in order to further reduce on-site installation time and cost. The prefabricated gable ends, like the prefabricated "T-braces", are temporarily stored in the central core (more specifically by being placed on the floor of the core) while the folded house is being shipped to the building site.

The last remaining stage of installation, namely interior finishing, can now proceed. Specifically, the edges of any interior surfaces of abutting structural members are appropriately taped, spackled and sanded, in preparation for applying final wall covering, e.g. paint, or wallpaper. Thereafter, subflooring and final hardwood planking or other final flooring materials are installed in the previously unfloored areas of the house, i.e. above pivots 4. Alternatively,the entire sub-floors and final floor covering can be installed on-site. While this latter approach slightly increases installation cost, it may be necessary, depending upon the final floor covering chosen by the owner, in order to eliminate any visible gaps or joint lines from appearing in the floor. Thereafter, molding and any remaining interior trim is now installed. At this point, the dwelling has been completely constructed and only requires connection to the local utilities—e.g. electricity and sewerage—for it to be completely habitable.

An exterior perspective view of the dwelling as it stands completely installed and ready for occupancy is shown in FIG. 14.

In the illustrative embodiment described herein, heat is provided through electric baseboard. While electric heat is usually relatively expensive to operate, it is the least expensive to install. Consequently, separate electric baseboard units are installed along the interior bottom edge of various interior core walls and various folding walls. However, to minimize heating costs, a separate thermostat is installed in each room during prefabrication.

Other types of heating, ventilating, and air conditioning systems, where desired, can be substituted for electric baseboard or added in addition thereto. Any desired system can be substantially shop installed during prefabrication. In addition, the necessary cable or wiring requirements (i.e., electrical, telephone, television, etc.) can be shop installed during prefabrication.

Since the weight of a residential dwelling constructed in accordance with the teachings of the present invention is primarily supported by the walls comprising the central core, this advantageously permits all the pivoting structural members to be made relatively light. Consequently, this permits each member to be pivoted into position by a few workers without using any heavy machinery. Furthermore, the minimal weight inherent in the structure eliminates the need to incorporate any columns into the structure or to to construct the foundation from reinforced concrete. Consequently, these factors advantageously reduce installation cost.

Figure 15:
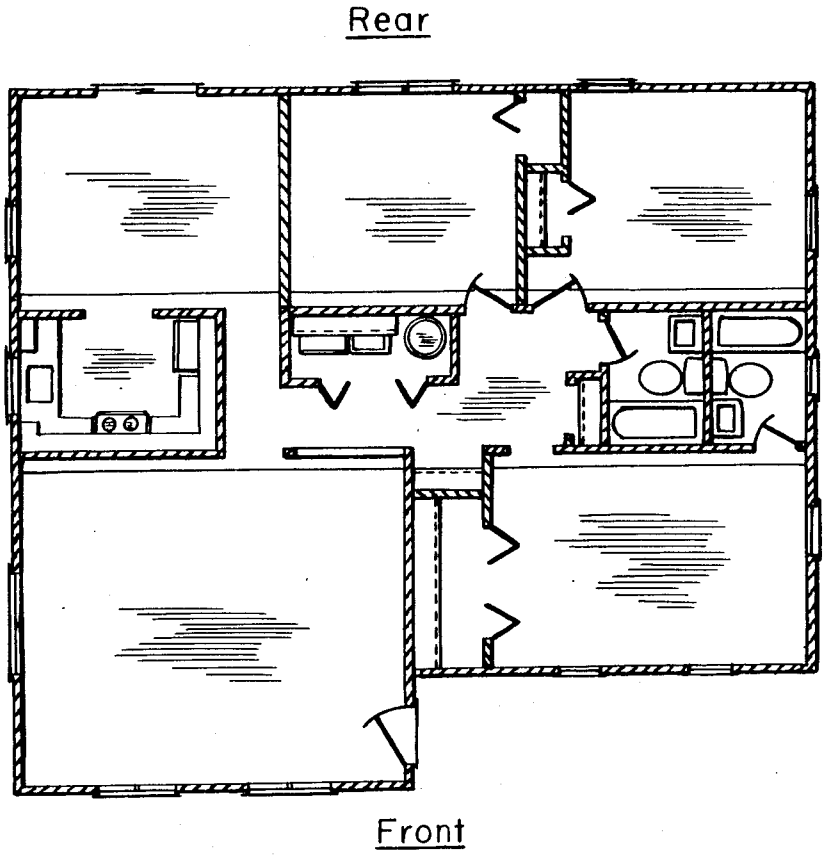
FIG. 15 is a plan elevational view of the interior of another structure shown in a completely unfolded position which embodies the present invention and illustrates its use in structures of different shapes.

A floor plan of one of many alternate embodiments of a folding residential dwelling embodying the principles of the present invention is depicted in FIG. 15. As is readily apparent from this figure, the exterior pivotable front walls are not limited to being co-planar when fully unfolded. As shown, the two walls making up the exterior front wall can be staggered to create a relatively large living room, for example, and also lend a pleasing appearance to the front of the dwelling. In a similar fashion, any of the other folding walls and/or core walls are also not constrained to entirely lie in a single plane but can instead by comprised of a number of staggered or otherwise non-co-planar sections. Moreover, the pivoting floor and/or ceiling member can also take on many varied non-co-planar geometries to create many diverse and architecturally pleasing layouts. Consequently, a variety of differently shaped structures, including but by no means limited to a simple rectangular layout, can be easily fabricated using the principles of the invention.

Figure 16:
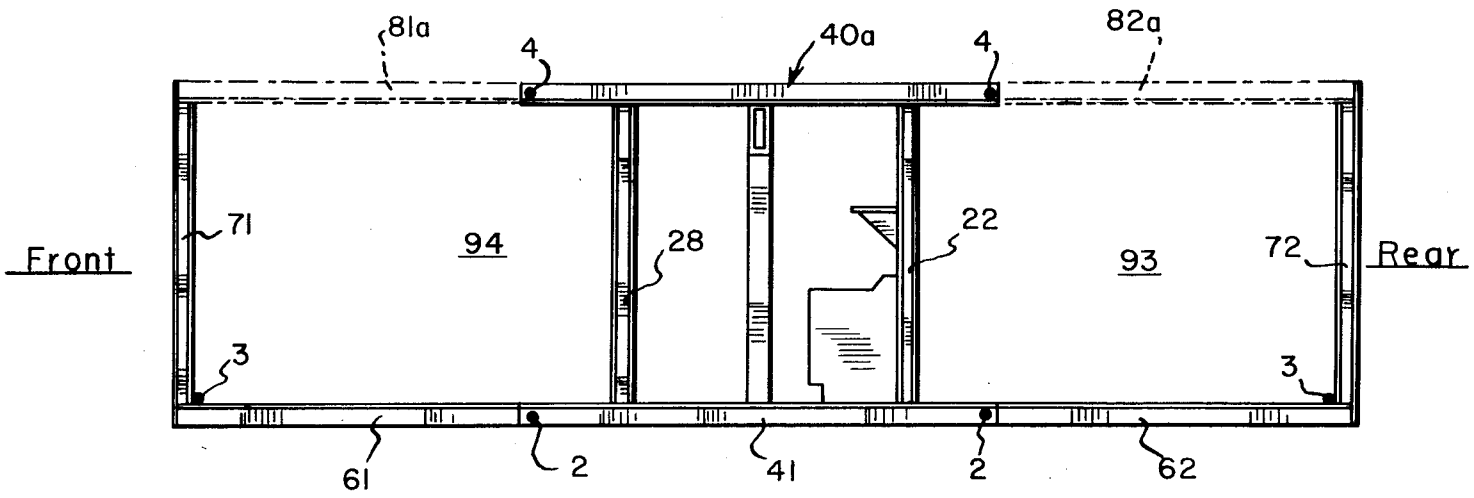
FIG. 16 is a cross-sectional view of an alternate embodiment of a single story prefabricated structure, shown completely unfolded.

FIG. 16 illustrates a single story structure which can be provided with a flat roof or used as the first or lower floors of a multi-story structure. The single story structure or the lower floors of the multi-story structure are not provided with folding roofs or roof trusses, but instead have ceiling members 40*a* only in the area of the central core. Then, when such structure is to be used as a single story house, ceiling members 81*a*, 82*a* for the rooms adjacent to the central core are installed.

These members 81*a*, 82*a* shown in phantom in FIG. 16 may be pivotally connected to ceiling members 40*a* in the same manner as the pivoting floor sections are connected to the core floor. Alternately, these ceiling members 81*a*, 82*a* may be field installed. In either embodiment, these ceiling members are partially supported at their opposite end by a pivotable wall member.

Then, a flat or conventional roof can be constructed upon these ceiling members 40*a*, 81*a*, 82*a* to complete the single story structure. For multi-story, construction, the lower structures are not provided with such ceiling members 81*a*, 82*a*, since the floors of the adjacent upper structure 61, 62 become the ceiling members for the lower structure.

For multi-story fabrication, it is advantageous to use 2"×10" wooden beams 40*a* positioned upon the central core and to stagger the position of these beams with respect to the position of the floor joists 40 of the upper structure. Also, these beams extend slightly beyond the width of the central core 5 so as to provide enough area to pivotally connect the folding side and internal wall members. In this construction, the floor joists 40 of the upper structure will be positioned between the wooden beams 40*a* of the lower structure. Also, the core walls, 22, 28 are sufficiently sized to support the weight of the upper structure. Then, as mentioned above, the floor members 61, 62 of the upper structure become the ceiling members of the lower structure.

Figure 17:
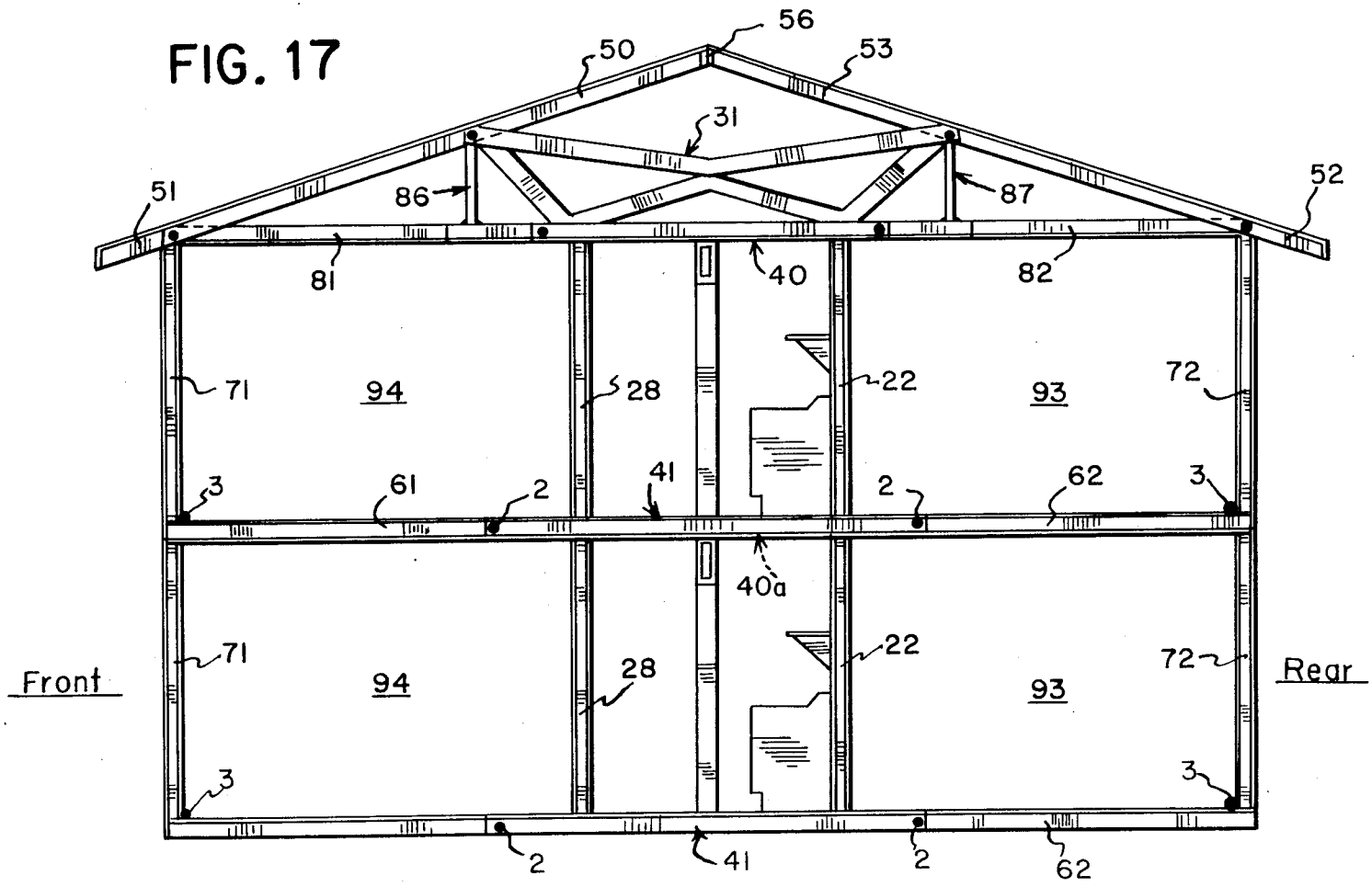
FIG. 17 is a cross-sectional view of applicant's two story prefabricated house shown completely unfolded.

Specifically, to construct a two-story residential dwelling as shown in FIG. 17, two folding structures—an upper and a lower of the type described previously—are stacked on top of each other. The main difference between these structures is that the lower structure does not contain a roof and appears substantially as shown in FIG. 16. At the time of on-site installation, the lower structure is first appropriately positioned on the foundation supports and wood plates which forms part of the foundation, and is then completely unfolded. All the folding structural members of the lower stucture are then secured in position. As shown in FIG. 16, the lower folding structure is provided with 2"×10" ceiling beams 40*a* straddling the central core. As mentioned above these 2"×10" beams are positioned in a staggered configuration such that they would not be directly under the floor joists of the upper structure. Then, the upper structure, in a completely folded position, is placed above the lower structure and the floor joists of the upper structure are supported by the walls of central core of the lower structure. In this arrangement, the floor joists of the upper structure 61, 62 become the ceiling rafters of the lower structure. All the ceiling beams 40*a* of the lower structure thus abut against and are attached to the central core floor joists using appropriately sized nailing plates and nails. The remaining folding structural members of the upper structure are unfolded into position and secured as described hereinabove.

Appropriate openings are provided both in the ceiling of the central core of the lower structure and in the core floor member of the upper structure during their prefabrication in order to accommodate a stair case, which can be installed in the lower structure during its prefabrication. Any necessary banisters and the like are installed during the final (interior finishing) stage of on-site installation. Unless the two-story dwelling is to be a two family-house, there is little if any need to include any appliances (and/or a hot water heater) in the upper structure. Thus, the area reserved for the kitchen and closet in the central core can be converted into other usable space, e.g. a den or study.

As can be readily appreciated by those skilled in the art, multi-story structures in excess of two stories can be easily constructed in a similar manner to that described above. The number of separate folding structures that can be stacked to form the multi-story structure is essentially determined by the weight of each folding structure, and the amount of weight that can be supported by both the foundation and the walls in each folding structure—particularly the lowest in the stack.

While the pivoting structural members (walls, floors, ceiling and roof members) comprising the folding residential dwelling have been described above as folding and unfolding in a particular sequence it is readily apparent to those skilled in the art that any or all of these structural members can be readily folded and unfolded in a variety of different sequences. The particular sequence is determined by the desired volume of the folded structure and the particular materials used for the folding members and manner in which these members are constructed.

Although particular embodiments have been shown and described herein, a substantial variety of different embodiments of varying sizes and shapes and all incorporating teachings of the present invention may be devised by those skilled in the art without departing from the spirit and scope of the invention.

I claim:

1. A prefabricated folding structure comprising:

(a) at least one pre-erected central core comprising at least two oppositely arranged wall members and a floor extending between said at least two wall members;

(b) at least a first pivoting floor section;

(c) first pivoting means connecting said first pivoting floor section to said central core floor, said first pivoting means comprising means for transferring the load of said first pivoting floor section to said central core floor;

(d) at least three pivotable wall members;

(e) first means for pivotally connecting said third of said pivotable wall members to said pivoting floor section, said first pivotal connection means comprising an elongated member foldable along a predetermined crease line and capable of substantially maintaining its configuration when placed in either a folded or an unfolded condition about said crease line by a predetermined force;

(f) second means for pivotally connecting the remaining pivotal wall members to one of said central core wall members; and (g) a plurality of beams located above said central core for stabilizing and strengthening said central core; the prefabricated folding structure capable of forming either (i) a compact folded structure wherein said at least one pivoting floor section and said at least three pivotable wall members are pivotally positioned inwardly about said central core so as to rest in close proximity thereto and substantially parallel to said core wall member to which said two pivotal wall members are pivotally connected, or (ii) a sturdy habitable structure wherein said at least one first pivoting floor section and said at least three pivotable wall members are pivotally positioned outwardly from said central core so as to define at least one room adjacent to said central core.

2. The prefabricated folding structure according to claim 1 wherein said central core comprises at least two pair of oppositely arranged wall members having a generally rectangular configuration.

3. The prefabricated folding structure according to claim 2 wherein a predetermined number of said at least two pair of oppositely arranged central core wall members are utilizable as exterior walls with the remaining central core wall members being interior walls.

4. The prefabricated folding structure according to claim 1 wherein said first pivoting means further comprises means for reducing frictional forces during rotation of said pivoting floor section.

5. The prefabricated folding structure according to claim 1 wherein said first pivotal connecting means conform to a predetermined position of said third pivotable wall member relative to said pivoting floor section, which position varies from a generally parallel initial position to a predetermined final position.

6. The prefabricated folding structure according to claim 5 wherein said predetermined final position of said pivotable wall member is substantially perpendicular to said pivoting floor section.

7. The prefabricated folding structure according to claim 1 wherein each of said second pivotal connection means conforms to a predetermined position of said respective remaining pivotable wall members relative to said central core wall member, which position varies from a generally parallel initial position to a predetermined final position.

8. The prefabricated folding structure according to claim 7 wherein said predetermined final position of said pivotable wall member is substantially perpendicular to said central core wall member.

9. The prefabricated folding structure according to claim 1 further comprising at least one folding interior wall member for dividing said at least one room.

10. The prefabricated folding structure according to claim 1 further comprising a plurality of ceiling beams above said at least one room and means for connecting said plurality of room ceiling beams to said plurality of central core ceiling beams for horizontal support.

11. The prefabricated folding structure according to claim 8 wherein said plurality of room ceiling beams are also attached to and at least partially supported by said third pivotable wall member.

12. The prefabricated folding structure according to claim 1 further comprising a flat or conventional roof which is installed on said sturdy habitable structure.

13. A prefabricated folding structure comprising (a) at least one pre-erected central core comprising at least two pair of oppositely arranged wall members and a floor extending between said wall members;

(b) at least two pivoting floor sections;

(c) first pivoting. means connecting a first pivoting floor section to said central core floor and second pivoting means connecting a second pivoting floor section to the opposite end of said central core floor, said first and second pivoting means each comprising means for transfering the load of said first and second pivoting floor sections to said central core floor and means for reducing frictional forces in said first and second pivoting means during rotation of the pivoting floor sections;

(d) at least two sets of three pivotable wall members;

(e) first means for pivotally connecting each of said third of said pivotable wall members to said first and second pivoting floor sections respectively, said first pivotal connection means comprising an elongated member foldable along a predetermined crease line and capable of substantially maintaining its configuration when placed either in a folded or an unfolded condition about said crease line by a predetermined force, said folded condition corresponding to a generally parallel initial position of said third pivotal wall members relative to its respective pivotal floor section and said unfolded condition corresponding to a predetermined final position of said third pivotal wall members relative to said respective pivoting floor section;

(f) second means for pivotally connecting each of the remaining pivotal wall members of each set to each respective side of said oppositely arranged central core wall members, said second pivotal connection means capable of conforming to a predetermined position of said respective remaining pivotal wall members relative to said central core wall members, which position varies from a generally parallel initial condition to predetermined final position; and (g) a plurality of beams located above said central core for stabilizing and strengthening said central core, the prefabricated folding structure capable of forming either (i) a compact folded structure wherein said at least two pivoting floor sections and each of said at least three pivotable wall members are pivotally positioned inwardly about each respective side of said central core as to rest in close proximity thereto and substantially parallel to each of said at least two core wall members, or (ii) a sturdy habitable structure wherein first and second pivoting floor sections and said pivotable wall members are pivotally positioned outwardly from said central core so as to define at least two rooms adjacent to said central core.

14. The prefabricated folding structure according to claim 13 wherein a predetermined number of said at least two pair of oppositely arranged central core wall members have a generally rectangular configuration and are utilizable as exterior walls and the remaining central core wall members are interior walls.

15. The prefabricated folding structure according to claim 13 further comprising a plurality of ceiling beams above said at least two rooms and means for connecting each of said plurality of room ceiling beams to each end of said plurality of central core ceiling beams for partial horizontal support.

16. The prefabricated folding structure according to claim 14 wherein said plurality of room ceiling beams are also attached to and at least partially supported by at least one of said pivotable wall members.

17. The prefabricated folding structure according to claim 13 further comprising a flat or conventional roof which is installed on said sturdy habitable structure.

18. A prefabricated folding structure comprising (a) one pre-erected central core comprising two pair of oppositely arranged wall members having a generally rectangular configuration and a floor extending between said wall members wherein a predetermined number of said central core wall members are utilizable as exterior wall members and the remaining central core wall members are interior wall members;

(b) two pivoting floor sections;

(c) first pivoting means connecting a first pivoting floor section to said central core floor and second pivoting means connecting said second pivoting floor section to the opposite end of said central core floor, said first and second pivoting means each comprising means for transferring the load of said first and second pivoting floor sections to said central core floors and means for reducing frictional forces in said first and second pivoting means during rotation of the pivoting floor sections;

(d) two sets of three pivotable wall members;

(e) first means pivotably connecting each of said third of said pivotable wall members to said first and second pivoting floor sections respectively, said first pivotal connection means comprising an elongated member foldable along a predetermined crease line and capable of substantially maintaining its configuration when placed either in a folded or an unfolded condition about said crease line by a predetermined force, said folded condition corresponding to a generally parallel initial position of said third pivotal wall members relative to its respective pivoting floor section and said unfolded position corresponding to a substantially perpendicular position of said third pivotal wall member relative to its respective pivoting floor section;

(f) second means for pivotally connecting each of the remaining pivotal wall members of each set to each side of one pair of said oppositely arranged central core wall members, respectively, said second pivotal connection means capable of conforming td a generally parallel initial position of said respective remaining pivotable wall members relative to said central core wall members, to a substantially perpendicular final position; and (g) a plurality of prefabricated roof support trusses attached to the upper sides of one pair of oppositely arranged central core wall members and a plurality of folding roof members pivotally connected to said prefabricated roof support trusses; the prefabricated folding structure capable of forming either (i) a compact folded structure wherein said two pivoting floor sections and each said of three pivotable wall members are pivotally positioned inwardly about each side of said central core so as to rest in close proximity thereto and substantially parallel to each of said two core wall members, or (ii) a sturdy habitable structure wherein said first and second pivoting floor sections and said pivotable wall members are pivotally positioned outwardly from said central core so as to define two rooms adjacent to said central core.

19. The prefabricated folding structure according to claim 18 wherein said prefabricated central core contains all necessary and desired plumbing and electrical control means.

20. The prefabricated folding structure according to claim 19 wherein said central core contains at least a substantially prefabricated kitchen and a substantially prefabricated bathroom.

21. The prefabricated folding structure according to claim 18 wherein said folding roof member comprises an upper and lower folding roof section wherein each upper section is pivotally connected at one of its ends to a corresponding lower section and to said prefabricated roof support trusses.

22. The prefabricated folding structure according to claim 21 wherein said lower folding roof sections are at least partially supported by a pivotable wall member which is attached to a pivoting floor section.

23. The prefabricated folding structure according to claim 22 further comprising a plurality of free standing partitions which in said compact folded structure are positioned substantially parallel to and alongside at least one of said interior said central core walls, or when said folding structure has been completely unfolded, are positioned to further define a predetermined number of rooms and closets arranged adjacent to said central core.

24. The prefabricated folding structure according to claim 18 wherein said pivotable wall members and said pivoting floor sections are configured and dimensioned to provide sufficient free space parallel to said central core walls when the structure is folded for holding non-pivotally connected building components until said structure is unfolded.

25. The prefabricated folding structure according to claim 24 wherein said non-pivotally connected building materials comprise free standing wall partitions and roof brace supports.

26. The prefabricated folding structure according to claim 18 wherein said central core and pivotable wall members include all necessary cable and/or wiring requirements.

27. A method for erecting a sturdy habitable dwelling from a prefabricated folding structure which comprises:

(a) prefabricating a compact folded structure according to claim 1;

(b) transporting said compact folded structure to a construction site;

(c) supporting said compact folded structure on at least two properly positioned central core support means;

(d) unfolding said compact folded the structure by (i) pivoting said first pivoting floor section to a horizontal position onto support means;

(ii) pivoting said third pivotable wall member to a vertical position with respect to said first pivoting floor section;

(iii) pivoting said other pivotable wall members; and (e) finishing final construction details to form the sturdy habitable structure.

28. The method according to claim 27 which further comprises adding a plurality of ceiling beams above said roof upon said room and central core ceiling beams.

29. A method for erecting a sturdy habitable dwelling from a prefabricated folding structure which comprises:

(a) prefabricating a compact folded structure according to claim 13;

(b) transporting said compact folded structure to a construction site;

(c) supporting said compact folded structure on at least two properly positioned central core supports on a building foundation;

(d) unfolding said compact folded structure by (i) pivoting said first pivoting floor section to a horizontal position onto support means;

(ii) pivoting said second pivoting floor section to a horizontal position onto support means;

(iii) unfolding each respective third pivotable wall members to a final position relative to said first and second pivoting floor sections; and (iv) pivoting said remaining pivotable wall members according to a predetermined sequence to their final positions; and (e) finishing final construction details to form the sturdy habitable structure.

30. The method according to claim 29 wherein said predetermined sequence of pivoting said remaining pivotable wall members comprises:

(i) pivoting the outermost wall member outwardly to a substantially perpendicular final position relative to said central core wall;

(ii) pivoting the next outermost wall member outwardly to a substantially perpendicular final position relative to said central core wall; and (iii) repeating (ii) until all remaining wall members are pivoted outwardly to substantially perpendicular final positions relative to said central core wall.

31. The method according to claim 29 which further comprises adding a plurality of ceiling beams above said room and attaching said plurality of ceiling beams to said central core ceiling beams.

32. A method for erecting a sturdy habitable dwelling from a prefabricated folding structure which comprises:

(a) prefabricating a compact folded structure according to claim 18;

(b) transporting said compact folded structure to a construction site;

(c) supporting said compact folded structure on at least two properly positioned central core support means;

(d) unfolding said compact folded structure by (i) rotating said first pivoting floor section around said first pivoting means to a horizontal position onto a floor support;

(ii) rotating said second pivoting floor section around said second pivoting means to a horizontal position onto a floor support by said second pivotal means;

(iii) unfolding each said third pivotable wall members by said first pivotal connection means to a substantially perpendicular final position relative to said first and second pivoting floor sections; and (iv) unfolding said remaining pivotable wall members by said second pivotal connection means according to a predetermined sequence to their final position;

(e) finishing final construcion details to form the sturdy habitable structure.

33. The method according to claim 32 wherein said predetermined sequence of pivoting said remaining pivotable wall members comprises:

(i) pivoting the outermost wall member outwardly to its final position:

(ii) pivoting the next outermost wall member outwardly to its final position; and (iii) repeating (ii) until all remaining wall members are pivoted outwardly to their final positions.

34. The method according to claim 32 which further comprises adding a plurality of ceiling beams above said roof rooms and attaching said plurality of ceiling beams to said central core ceiling beams.

35. A method for erecting a sturdy habitable multi-story structure from a plurality of prefabricated folding structures which comprises:

(a) prefabricating a plurality of compact folded structures according to claim 1;

(b) transporting said compact folded structures to a construction site;

(c) supporting a first compact folded structure on at least two properly positioned central core support means;

(d) unfolding the structure by (i) pivoting said first pivoting floor section to a horizontal position onto support means;

(ii) pivoting said third pivotable wall member to a vertical position with respect to said pivoting floor section; and (iii) pivoting said other pivotable wall members to their final position;

(e) positioning a second compact folded structure above said unfolded first structure;

(f) unfolding said second compact folded structure in the same manner as the first; and (g) finishing final construction details to form the sturdy habitable multi-story structure.

36. The method according to claim 35 further comprising repeating steps (e) and (f) as often as necessary to form the desired multi-story structure;

37. The method according to claim 35 which further comprises adding a plurality of ceiling beams above said room and attaching said plurality of ceiling beams to said central core ceiling beams.

38. The method according to claims 37 further comprising installing a flat or conventional roof to the uppermost structure after it is unfolded.

39. The method according to claim 35 further comprising providing the uppermost structure with a plurality of prefabricated support trusses attached to its central core ceiling members and a plurality of folding roof sections pivotably connected to said prefabricated roof trusses.

40. The method according to claims 39 which further comprises pivoting said plurality of folding roof sections in upper and lower folding roof sections wherein each upper section is pivotably connected at one of its ends to a corresponding lower section and to said prefabricated roof support trusses.

41. The sturdy habitable structure produced according to the method of claim 27.

42. The sturdy habitable structure produced according to the method of claim 29.

43. The sturdy habitable structure produced according to the method of claim 32.

44. The sturdy habitable multi-story structure produced according to the method of claim 35.

45. The sturdy habitable structure produced according to the method of claim 36.

* * * * *